US008935883B2

(12) United States Patent
Coubray et al.

(10) Patent No.: US 8,935,883 B2
(45) Date of Patent: Jan. 20, 2015

(54) BARRIER OPERATOR WITH RACK AND PINION DRIVE AND COUPLING ASSEMBLY FOR AN INTEGRATED DOOR AND OPERATOR

(75) Inventors: Bruce Arthur Coubray, Auckland (NZ); Alan Keith Coubray, Auckland (NZ)

(73) Assignee: The Chamberlain Group, Inc., Elmhurst, IL (US)

( * ) Notice: Subject to any disclaimer, the term of this patent is extended or adjusted under 35 U.S.C. 154(b) by 999 days.

(21) Appl. No.: 12/496,512

(22) Filed: Jul. 1, 2009

(65) Prior Publication Data

US 2010/0024308 A1 Feb. 4, 2010

Related U.S. Application Data

(60) Provisional application No. 61/084,428, filed on Jul. 29, 2008.

(51) Int. Cl.
*E05F 15/16* (2006.01)

(52) U.S. Cl.
USPC ..... 49/199; 49/197; 49/139; 160/188

(58) Field of Classification Search
USPC ..... 49/197, 199, 200, 139, 140; 160/188, 160/201; 74/625
See application file for complete search history.

(56) References Cited

U.S. PATENT DOCUMENTS

| | | | | |
|---|---|---|---|---|
| 2,560,236 | A * | 7/1951 | McNinch et al. | 160/188 |
| 3,630,094 | A * | 12/1971 | Carli | 74/89.21 |
| 4,570,617 | A | 2/1986 | Baus | |
| 4,905,542 | A | 3/1990 | Burm et al. | |
| 5,222,403 | A * | 6/1993 | Angelini et al. | 74/89.21 |
| 5,680,729 | A | 10/1997 | Heffington | |
| 6,257,303 | B1 * | 7/2001 | Coubray et al. | 160/188 |
| 6,753,668 | B1 * | 6/2004 | Stewart et al. | 318/445 |
| 6,883,579 | B2 | 4/2005 | Olmsted | |
| 7,076,917 | B2 * | 7/2006 | Chang | 49/139 |
| RE40,001 | E | 1/2008 | Siegler et al. | |
| 7,997,324 | B2 * | 8/2011 | Olmsted | 160/201 |
| 2003/0209333 | A1 | 11/2003 | Olmsted | |
| 2004/0177934 | A1 | 9/2004 | Olmsted | |
| 2005/0126720 | A1 * | 6/2005 | Rekret | 160/201 |

OTHER PUBLICATIONS

Bistable Release Cam Drawings; 2004.

(Continued)

*Primary Examiner* — Gregory J Strimbu
(74) *Attorney, Agent, or Firm* — Fitch Even Tabin & Flannery LLP

(57) ABSTRACT

A barrier operator system including, method and kit described herein contemplate the use a rack and pinion drive mechanism which is mounted on tracks of the operator system such that the pinion is positioned to engage the rack which is coupled to the barrier to move the barrier along the tracks in both the upstream and downstream direction. Prepositioning the pinion relative to the rack and using the rack and pinion drive permits coupling the rack and motor at any variety of points along the barrier to move it. Further when the barrier is an over head door, such as a garage door, the door is connected to the rack through a coupling assembly which connects the door to the rack.

7 Claims, 15 Drawing Sheets

(56) References Cited

OTHER PUBLICATIONS

Owner's Manual for Residential Jackshaft Opener—3800; Elite Series Garage Door Opener; The Chamberlain Group, Inc.; Jun. 2006.

Owner's Manual for Security+ Garage Door Opener—Model 3800; Elite Series; The Chamberlain Group, Inc.; Copyright 2006.

* cited by examiner

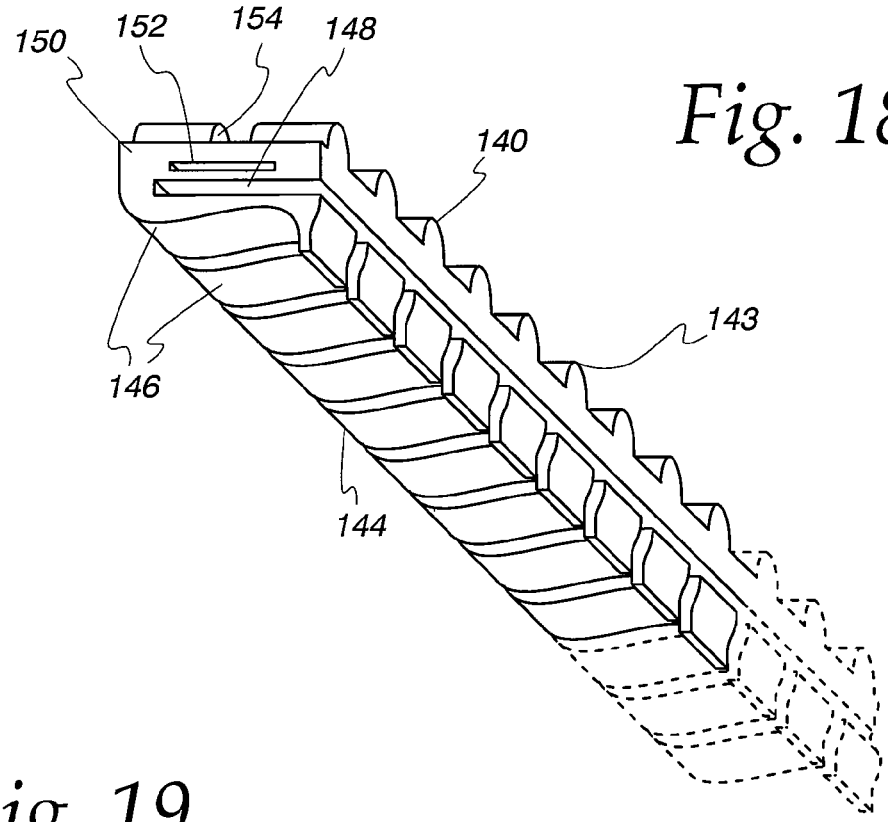
Fig. 18
Fig. 19
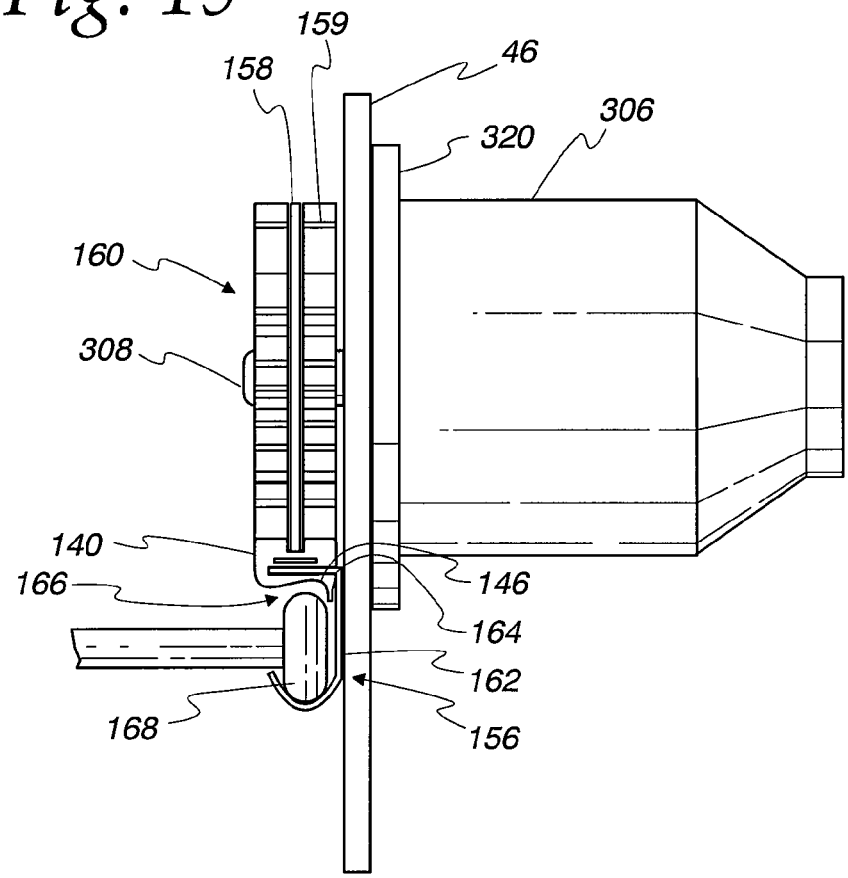

BARRIER OPERATOR WITH RACK AND PINION DRIVE AND COUPLING ASSEMBLY FOR AN INTEGRATED DOOR AND OPERATOR

This application claims the benefit of U.S. Provisional Application Ser. No. 61/084,428 filed Jul. 29, 2008 and entitled Barrier Operating System With Rack And Pinion Drive. The latter described provisional application is incorporated by reference as if fully rewritten herein.

TECHNICAL FIELD

This invention relates generally to barrier operator systems and, more particularly, to barrier operator systems which include a motor driven push-pull drive system which drives the barrier and which may be coupled and uncoupled from the barrier for manual operation.

BACKGROUND

Moveable barrier operators of various kinds are known in the art and include, for example, so-called garage door openers. Movable barrier operators typically serve to facilitate the automated movement of one or more corresponding movable barriers (such as, but not limited to, single panel and segmented garage doors, rolling shutters, pivoting and sliding gates, arm guards, and so forth). While the movable barrier operators are able to facilitate automated movement, it is often desirable to be able to manually operate the moveable barrier. To increase the flexibility of an automatic barrier operator, a manual override may be employed. For example, if there is a power loss or a malfunction of the operator, the user may want to manually move the garage door until such power loss or malfunction is remedied.

Garage door openers utilize various types of motor driven drive systems. Some drive systems use a motor driven chain which moves a "trolley" or arm which is connected to a barrier or door. The chain pulls the barrier or door open, or the motor which drives the chain, reverses and the chain pulls the barrier shut. For manual operation the trolley and chain are decoupled from the door.

Alternatively, rack and pinion or push-pull drive chain mechanisms are known to move the barriers between a closed and an opened position. In these latter mechanisms, the rack or the push-pull chain alternately push and pull a barrier between an open and closed position. U.S. Pat. No. 6,257,303 issued to Coubray describes a rack and pinion drive mechanism to open and close an overhead door where the rack and pinion drive mechanism moves the door on rollers up and down on parallel tracks near the edges of the door. In Coubray the pinion is not mounted on the tracks to position the pinion both before and after assembly of the system relative to a rack running along a channel inside the tracks. The drive pinion moves the door by engaging the rack within a rack channel that is associated with one of the tracks and the sectioned door. The Coubray rack and pinion mechanism is connected to the bottom of the door (see FIGS. 10A and 10B of U.S. Pat. No. 6,257,303 to Coubray) and the door is connected to the drive system through a clutch for connecting and disconnecting the motor via a keyed or dogged inter-engagement type of clutch. See Coubray at column 8, lines 1-5. For barrier operators that have internal limits, decoupling as described by Coubray results in the barrier operator losing positional information and not knowing where the barrier or door is with respect to the door limits of travel. This can result in the barrier operator slamming the barrier at a bottom or top physical limit which can cause damage to the barrier. Further, because Coubray's rack is coupled to the bottom of the door, this is not only inconvenient to the user, but potentially subjects the rack teeth to undue wear and the coupling mechanism to water, snow and other elements. This positioning also results in the Coubray pinion not being configured to exert driving forces upstream the pinion to drive the rack and door coupled to it upstream in the direction of the horizontal portion of the tracks and rack which are parallel to ground. Additionally Coubray does not describe the assembly of his system or how the parts of his system are configured to reduce installation error when the parts of the system are assembled on site. As a result of the forgoing, the Coubray system (1) may be prone to installation error because the engagement of the pinion with the rack is subject to misalignment during on site assembly or installation of the system which misalignment results in unnecessary wear, (2) looses its ability to properly stop at a set limit position when manually disconnected at the motor from the motor, and (3) is not versatile in not permitting coupling the rack to a barrier anywhere along the side of the barrier, especially when the barrier is an overhead moving door such as a garage door. In Coubray's system, the rack and pinion only pulls the door up and pushes it down due to the coupling of the rack to the door at the very bottom the door. Also in Coubray, when a user manually overrides the drive system, the motor is disconnected from the door at the motor and the user has to push or pull against the rack and pinion mechanism to move the door. This can cause the user considerable effort.

United States published patent application No. 2004/0177934 to Olmstead describes a garage door or barrier which is moved by a motor powered push-pull chain and a jack shaft. The jack shaft is mounted horizontally above the door opening with a sprocket at one end thereof and the end of the chain is connected to bottom of the door. In Olmstead manually moving the barrier causes the user to push or pull against the drive mechanism of the door. Indeed Olmstead expressly recognizes that "the push-pull chain 26 helps to keep individuals from raising the door" (paragraph 31, lines 15-16). This also makes it more difficult for the authorized user to manually move the garage door.

As mentioned, in the event of a power outage or system malfunction, a user may want to manually override the moveable barrier operator or drive mechanism to move the garage door. In standard barrier operators which use trolleys attached to a chain or belt, the moving chain may be disconnected from a trolley as described in U.S. Pat. No. 4,905,542 to Burm et al. With a trolley system as described in Burm, however, the motor usually is at an endpoint of an endless chain, and in such a system, fewer alternatives are available for positioning a motor which moves the barrier. This is not the case for a push pull mechanism, such as a rack and pinion drive.

Since a push-pull drive system, such as a rack an pinion drive or push-pull drive chain, may make manual operation of the garage door more difficult, it is advantageous to decouple the garage door from the drive system so that the user may manually move the door freely without having to work against the drive mechanism. Decoupling at the clutched arrangement which connects and disconnects the motor or barrier operator, as described in Coubray, disassociates the motor with the rack in such a way that the door may move independent of the motor. As described above, this may cause the motor to not retain the system limits which causes problems upon recoupling of the door to the motor. As mentioned, unregistered or unknown limits may result in the barrier operator slamming the barrier at the bottom or top physical limit which may cause damage to the barrier or drive system.

Thus, reengagement of the connection between the door and the drive system in such a way as to retain the limits helps decrease unnecessary wear on the parts and assists in maintaining optimal performance of the system.

Positioning of the coupling mechanism along the tracks may also be important. The coupling mechanism may be positioned such that pinion or sprocket teeth may be pushing and pulling at different times during the opening and closing operations. For example, if the rack, pinion, and motor are near the top or bottom of the system, the wear on the system may be uneven. Further as described above, having the rack, pinion, and motor at the bottom of the door may deleteriously expose them to the elements such as rain, ice or snow. Some owners may desire the coupling mechanism be located at a specific location and thus it is desirable that the system be versatile such that the rack may be coupled to the barrier at a number of positions along the side of the barrier.

SUMMARY

The barrier operator system, method and kit described herein contemplate the use of a rack and pinion drive mechanism which is mounted on tracks of the operator system such that the pinion is positioned to ideally engage the rack which is coupled to the barrier to move the barrier along the tracks in both the upstream and downstream direction. The rack is coupled to the barrier such that during opening or closing of the barrier, the pinion may push the rack using rack teeth and pinion teeth surfaces facing both upstream and downstream and pinion teeth facing both upstream and downstream to move the door along at least one track positioned on at least one side of the door. Positioning the pinion and the motor driving the pinion along the tracks with a pinion mounting assembly, which is attached to the at least one of the tracks, positions the pinion to engage and move the rack along the trolley track or trolley track channel when the pinion is operatively coupled to a motor which drives the pinion. Pre-positioning the pinion relative to the rack and using the rack and pinion drive as described herein permits coupling the rack and motor at any variety of points along the barrier to move it. Moreover, such pre-positioning of the pinion permits precise engagement of the pinion with the rack prior to the on site installation of the barrier and barrier operator system. Precise positioning of the pinion relative to the rack avoids unnecessary pinion wear and rack wear, and further avoids less than optimal engagement between the pinion and rack. Further when the barrier is an over head door, such as a garage door, the door is connected to the rack through a coupling assembly mounted to at least the upper one half to upper top third of the door where the coupling assembly does not run or connect the barrier to the rack through the motor, but rather runs directly from the door to the rack.

The coupling assembly has a rack engagement mechanism which has teeth which engage the rack teeth. In one aspect the rack engagement mechanism engages the rack through an elongated window in a channel through which the rack runs. The coupling assembly also includes a first engagement device between the barrier and the drive mechanism, a second engagement device between the barrier and the drive mechanism and a bistable engagement device which may include the first or second engagement device. The bistable engagement device has at least to stable states. In one stable state the first engagement device engages with the second engagement device. In the second stable state the first engagement device is not engaged with the second engagement device.

The coupling assembly has the first engagement device, the second engagement device and the bistable engagement device which includes a resiliently reciprocating coupling mechanism. The first engagement device connects with the drive mechanism, such as, for example, the rack in a rack and pinion drive or a push-pull chain in a chain drive. The second engagement device is mounted on or is connected to the barrier and connects and disconnects with the first engagement device through the reciprocating coupling mechanism. The reciprocating coupling mechanism moves the second engagement device to couple the second engagement device (and barrier) with the first engagement device, the drive mechanism and motor. Alternatively, as described below, reciprocating coupling mechanism moves the first engagement device into a mated position with the second engagement device. The resiliently reciprocating coupling mechanism has at least two stable positions and moves between these two stable positions. The resiliently reciprocating coupling mechanism moves between the at least two stable positions: a coupled position and uncoupled position. The coupled position connects the barrier to the push-pull drive mechanism and motor; the uncoupled position disconnects the barrier from the drive mechanism and motor. Hence, to manually move the barrier in the uncoupled position, the drive mechanism and motor will not resist manual movement of the door.

In one aspect, the first engagement device (which connects to the drive mechanism) is coupled to or associated with the bi-stable engagement device which moves the first engagement device to connect it to the second engagement device. The bi-stable engagement device is configured to move the first engagement device into a connected and unconnected position with an engaging or receiving portion on the second engagement device.

In another aspect, the bi-stable coupling device is coupled to or associated with the second engagement device (mounted on or connected to the barrier), such that the bi-stable coupling device moves the second engagement device into an engaging or receiving coupled position with the first engagement device.

In one important aspect, a rack engagement mechanism which engages a rack is mounted on a pin. The pin engages the second engagement device which is mounted on the top third of the door. The reciprocating coupling mechanism moves walls which form a part of the second engagement device to a first stable position to engage the pin and to couple the door with the rack through the rack engagement mechanism. The reciprocating coupling mechanism also can retract the walls to a second stable position to disengage with the pin and disengage the rack from the door. No matter the location of the coupling assembly, the rack engagement mechanism, the second engagement device and the pin (which forms the first engagement device) as described herein permit the barrier or door to be coupled and decoupled from the rack as opposed to coupling and decoupling the barrier through a connection in the motor with the pinion. This permits the motor to maintain its registration as to the position of the barrier at least in part because the relative positions of the rack, the coupling assembly and motor memory as to the barrier's position do not change as the barrier is manually moved.

Because the barrier operator system, method, and kit described herein contemplate the use of the coupling assembly which couples and decouples the barrier from the motor and rack and pinion drive mechanism where upon uncoupling of the barrier from the drive mechanism and motor via the coupling assembly, a user is able to manually move the barrier with relative ease from the closed and open positions. This is because the decoupled barrier may be manually moved without pushing or pulling and moving the drive mechanism or the motor. In its decoupled state, the push-pull chain or rack and pinion portion of the push-pull drive mechanism is not moved with the barrier, nor is any mechanism forming part of the motor pushed or pulled when the decoupled barrier is moved manually.

The coupling assembly connects the push-pull drive mechanism to the barrier or door to move the door with the drive mechanism and motor along the track(s). In such a configuration, the coupling assembly is not between the drive mechanism and the motor and is not in the motor. Rather the coupling assembly is between the barrier and the drive mechanism and connects the barrier to the drive mechanism and the drive mechanism is connected to and driven by the motor. The barrier may be coupled to the drive mechanism at a variety of locations along the barrier and the opening because the coupling assembly is not directly connected to the motor, but rather is between the barrier and the drive mechanism. In considering how the motor, drive mechanism, and barrier are coupled to each other, moving from the motor to the barrier, the motor is downstream the drive mechanism and the drive mechanism is downstream the barrier and the coupling assembly is not directly attached to the motor. In one illustrative embodiment, the barrier is an over head door, such as a garage door, and the coupling assembly is mounted between the upper one half to the upper top third of the door with the drive mechanism downstream the coupling assembly and the motor downstream the drive mechanism.

The moving bi-stable engagement device and coupling assembly move either the first or second engagement device such that an engagement connector engages with the first or second engagement device to connect the two engagement devices. The engagement connector or one of the engagement devices moves laterally and perpendicularly relative to the barrier from an engaging position to a disengaging position. The engagement connector may be a connecting pin associated with the first engagement device which pin is moved into a hole or aperture of the second engagement device which is connected to the barrier. This connects the barrier with the driving mechanism and motor. Alternatively, walls may move laterally from the second engagement device toward a connecting pin or rod which forms part of the first engagement device, where the moving walls provide a hole or slot to engage with the connecting pin.

In important aspect, the coupling assembly includes a coupling mechanism which has a reciprocating lever arm which reciprocates around a pivot at a pivot point. It also includes a cam engaging projection orthogonally extending from the arm and a reciprocating pivoting cam plate having cam channels within which the cam engaging projection extending from the arm moves. The channels have bottoms which are cam surfaces upon which the end of the cam engaging projection cams. The channels have angled ramp-like bottoms which terminate in a lower first and a lower second stable base or bottom positions within which the cam engaging projection may drop and reside after camming up on an upward inclining channel bottom. The coupling mechanism is bi-stable and further includes a biasing device such as a spring or resilient cord attached to one end of the lever arm. The biasing device biases movement of the lever arm and cam engaging projection extending from the arm as cam engaging projection moves over the cam surfaces on the cam plate. As the projection moves on the cam surfaces from a first to second stable position, one end of the plate and lever arm pivot to accommodate the cam engaging projection moving through the channels on the cam surfaces and the lever arm moves from an extended engaged position to a retracted disengaged position. The cam engaging projection moves along the channels on the cam surfaces from the first stable position to the second stable position as the lever arm is reciprocally rotated around the pivot at the pivot point with the biasing device biasing the reciprocating arm from one stable position to the other. When the projection on the reciprocating arm is seated in the second stable base position, the reciprocating arm is positioned such that the engagement connector or connecting pin does not engage a receiving portion of one of the engagement devices. The cam engaging projection is moved to the first stable base position by pulling the resiliently biased reciprocating arm and cam engaging projection to reciprocate the arm around a pivot point. The cam engaging projection extending from the arm moves through the channels along the cam surfaces to the first stable base position in the channels of the plate. The bottom surfaces of the channels provide ramp-like surfaces for the engaging projection extending from the arm. The cam engaging projection moves or slides along these ramp-like surfaces on the cam plate between two stable positions as the plate is pivoted and the arm is reciprocated. The cam engaging projection moves along the ramp-like surfaces from the first to the second position when the floor of the channel bottoms to such stable positions. The first and second engagement devices are coupled or decoupled as the reciprocating lever arm moves either the first or second engagement device into engagement or disengagement with the other via the engagement connector.

The coupling assembly can be moved to a number of positions along a side of the barrier and the drive mechanism and does not have to be in the same general position where the motor drives the pinion and the rack. Coupling and decoupling the door from a push-pull chain or rack of a rack and pinion drive for the barrier outside of the motor permits the motor to maintain its registration with respect to the position of the barrier because the relative positions of the chain or rack, coupling assembly, and motor do not change as the barrier is manually moved. Hence the relative position of the barrier, drive mechanism and motor do not change when the barrier is re-engaged with the drive mechanism and motor.

Practicing the method described herein engages and disengages a barrier from a push-pull drive or rack and pinion drive mechanism between an open and closed position. In a barrier moving system as described above, the method includes the resiliently reciprocating a coupling mechanism to move the first and second engagement devices into a mated and unmated position. A coupling assembly which includes the coupling mechanism also includes the first and a second engagement devices and an engagement connector (which may be a connecting pin which may form a part of one of the engagement devices) which connects the two engagement devices. The engagement connector together with the first and second engagement devices connect the barrier to the push-pull drive mechanism. The method includes resiliently reciprocating the coupling mechanism between a bi-stable configuration which configures one of the engagement devices in a first stable mated position which connects the engagement devices and couples the barrier with the push-pull drive mechanism and a second stable unmated position. The method also includes decoupling the barrier from the push-pull drive mechanism by resiliently reciprocating the coupling mechanism from the first stable mated position to a second unmated position which decoupling disconnects the engagement devices from each other.

To pre-position the pinion relative to the rack, the barrier operator system as described herein may be assembled by a kit. The kit includes at least one rack and pinion drive and at least one pinion mounting assembly which is configured to be mounted on the at least one trolley track section to make it an integral part of the track section. The pinion mounting assembly includes holes for the pinion and for receiving fasteners for mounting the pinion mounting assembly onto the trolley track section. The track section with pinion mounting assembly mounted thereon is effective for being assembled into tracks which are in parallel relation at the side edges of the barrier with assembly of the system. The pinion mounting assembly mounted on the track section positions the at least one pinion to engage and move the rack along the trolley track when the pinion is operatively coupled to the motor. The kit eliminates the potential for installation error of the rack and pinion drive by pre-positioning the pinion on the tracks such that it will drivingly engage the rack when the rack in positioned with respect to the channel of the tracks after assembly of the kit. This is especially the case when the kit is being used to retrofit the rack and pinion drive into an already existing door or barrier and track system which already had two parallel tracks upon which the door moves.

The kit may include include the coupling assembly which includes the first engagement device, the second engagement device and the resiliently reciprocating coupling mechanism. The first engagement device is configured to engage the drive mechanism; the second engagement device is configured to be coupled to the barrier. The resiliently reciprocating coupling mechanism moves one of the first and second engagement devices into engagement with the other. One of the first and second engagement devices may have an engagement connector which couples the devices together to connect the barrier to the push-pull drive mechanism. The coupling mechanism resiliently reciprocates between a bi-stable configuration which configures the engagement devices in a first stable mated position which connects the engagement devices and couples the barrier with the push-pull drive mechanism and a second stable unmated position where the barrier is decoupled from the push-pull drive mechanism. The barrier is coupled directly to the rack through the rack engagement mechanism and the first and second engagement devices. Not coupling the door to the rack through the motor, allows disengagement and reengagement of the door with the rack at a specific location keeping the same registration of the motor with respect to the rack. Hence, the operating limits of the door can be carried at the operator and do not need to be separated.

The barrier operator system, method and kit described herein contemplate the use of a rack and pinion drive mechanism which is mounted on tracks of the operator system such that the pinion is positioned to ideally engage the rack which is coupled to the barrier to move the barrier along the tracks in both the upstream and downstream direction. The rack is coupled to the barrier such that during opening or closing of the barrier, the pinion may push the rack using rack teeth and pinion teeth surfaces facing both upstream and downstream and pinion teeth facing both upstream and downstream to move the door along at least one track positioned on at least one side of the door. Positioning the pinion along the tracks with a pinion mounting assembly to one side of a barrier and opening, which pinion mounting assembly is attached to the at least one of the tracks, positions the pinion to engage and move the rack along the trolley track or trolley track channel when the pinion is operatively coupled to a motor which drives the pinion. Pre-positioning the pinion relative to the rack and using the rack and pinion drive as described herein permits coupling the barrier with the rack and the pinion and the motor with the rack at any variety of points along the barrier, and to the side of the barrier and opening, to move the barrier. Moreover, such pre-positioning of the pinion permits precise engagement of the pinion with the rack prior to the on site installation of the barrier and barrier operator system. Precise positioning of the pinion relative to the rack avoids unnecessary pinion wear and rack wear, and further avoids less than optimal engagement between the pinion and rack. In one aspect the rack engagement mechanism engages the rack through an elongated window in a channel through which the rack runs. The rack engagement mechanism attached to the coupling assembly which resiliently engages and disengages the rack from the door. No matter the location of the coupler, the rack engagement mechanism and the coupling assembly as described herein permit the barrier or door to be coupled and decoupled from the rack as opposed to coupling and decoupling the barrier through a connection in the motor with the pinion.

In one aspect, the barrier operator system includes a motor, two parallel arcuate tracks on each side edge of the barrier, each track having at least one straight section on each side of a curved section. When coupled to the barrier with the coupling assembly, the rack and pinion drive is effective for moving the barrier along the tracks from an open and closed position. The barrier is driven in an upstream direction to an open position and is driven in a downstream direction to a closed position. The rack and pinion drive includes at least one rack configured to move along at least one of the tracks and at least one pinion mounted to engage and move the rack and the barrier which is coupled to the rack with the coupling assembly. In an important aspect, the at least one track provides a channel to the side of the barrier and opening and in which channel the rack is movingly engaged by the pinion to move the barrier. The pinion mounting assembly is mounted on the at least one of the tracks, the mounting assembly positioning the at least one pinion to engage and move the rack with respect to the channel when the pinion is operatively coupled to the motor.

In another aspect, the pinion has pinion teeth having pinion teeth engagement surfaces and the rack has rack channels configured to intermesh with the pinion teeth. The channels have sides and bottoms formed by rack teeth. The rack teeth have rack teeth engagement surfaces which engage pinion teeth engagement surfaces. The pinion mounting assembly holds the pinion relative to the rack so that the pinion teeth do not engage the bottoms of the rack channels, but drivingly engage rack teeth which face upstream and downstream in an opening or closing of the barrier.

Finally a method of maintaining a tolerance of distances between pinion teeth and rack teeth in a barrier operator system is contemplated. The system comprises a motor in combination with a rack and pinion drive which drives a garage door barrier, the rack and pinion drive including the pinion configured to be coupled to the motor and the rack which moves along a rail assembly. The method includes mounting the pinion to a pinion mounting assembly and mounting the pinion mounting assembly to a trolley track such that it positions the pinion relative to the rack prior to installation of the rack and pinion into the barrier operator system. In an additional aspect, the method also includes mounting the coupling assembly which includes a rack engagement mechanism and pin engagement mechanism configured to be mounted on a door so that the door can be coupled and decoupled from the rack at a position of coupling of the rack to the door which maintains a registration of the motor with respect to the rack.

BRIEF DESCRIPTION OF THE DRAWINGS

FIG. 10 A an enlarged view of the rack engagement mechanism, a second engagement device having walls extending therefrom which engage the pin extending therebetween, the extending walls resulting in the barrier being coupled to a rack and pinion drive mechanism.

FIG. 10 B is a cross section enlarged view of the bistable coupling mechanism which forms part of the coupling assembly and includes a reciprocating arm, cam plate and with the walls of the engagement device being withdrawn so as not to engage the pin extending from the rack engagement mechanism and the barrier being disengaged from the rack and the drive mechanism.

FIG. 10 C is a cross section enlarged view of the bistable coupling mechanism which forms part of the coupling assembly and includes a reciprocating arm, reciprocating cam plate and with the walls of the engagement device being extended so as to engage the pin extending from the rack engagement mechanism and the barrier being engaged with the rack and the drive mechanism.

FIG. 18 shows a flexible rack in an alternate embodiment where the rack has a channel forming legs which slidably engage top and under surfaces of a trolley track for slidable engagement of the rack with the trolley track.

FIG. 19 shows the flexible rack of FIG. 18 in slidable engagement with the surfaces of a trolley track channel and a pinion engaging the rack.

DETAILED DESCRIPTION

Figure 1:
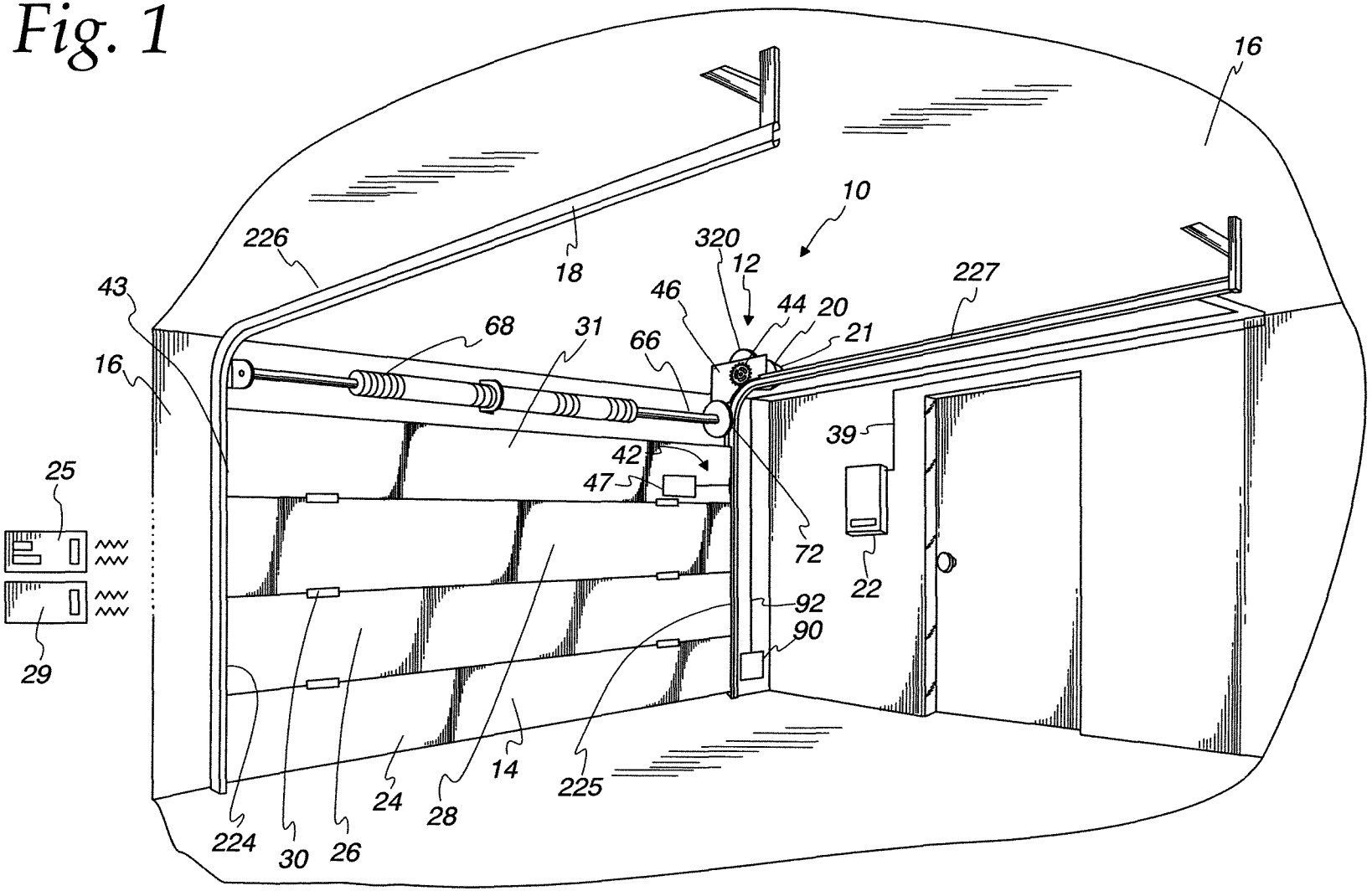
FIG. 1 is a perspective view of a garage with a door having sectional panels where the door sectional panel is coupled to a rack and pinion drive mechanism with a coupling assembly and with the door being in a closed position.

FIG. 1 illustrates a barrier movement operator 10 which is a garage door operator. It is to be understood that barrier movement operators for other types of barriers are within the scope of this invention. The barrier movement operator includes a head 12 mounted to the side of the barrier or door 14 on a pinion mounting assembly 46. The barrier is mounted on trolley tracks 18 which are on each side of the barrier 14 on garage walls or ceiling 16. The head 12 includes an electric motor 20 and a controller 21 for controlling the operation of the barrier operator and a motor mounting assembly 320. Although the operator system described herein can be used without a jackshaft, in system illustrated in FIG. 1, a jackshaft 66 is mounted horizontally above the door and includes torsion springs 68 which perform the function of counterbalancing part of the weight of the door to reduce the amount of force required to raise the door 14. In the lowered position of the door, the springs 68 are wound to the maximum extent providing a lifting force to counter-balance the weight of the door in order to lift it. In the elevated position of the door, the torsion springs are partially unwound reducing the counter balancing force provided. A pull up cable (not shown) operably connects the jackshaft to the door to exert the force of the torsion spring on the door. The pull up cable is configured to roll up on roll up drum 72.

The system also may include hand held transmitter units 25 and 29 which are adapted to send wireless signals to an antenna position on the head unit 12. A switch module 22 is mounted on an inside wall of the garage. The switch module is connected to the head by wires 39 to activate the motor and move the door up and down.

As seen in FIG. 1, the barrier or garage door 14 is a sectional door having a plurality of rectangular panels 24, 26, 28 and 31. The panels are connected by a plurality of hinges 30.

Figure 1A:
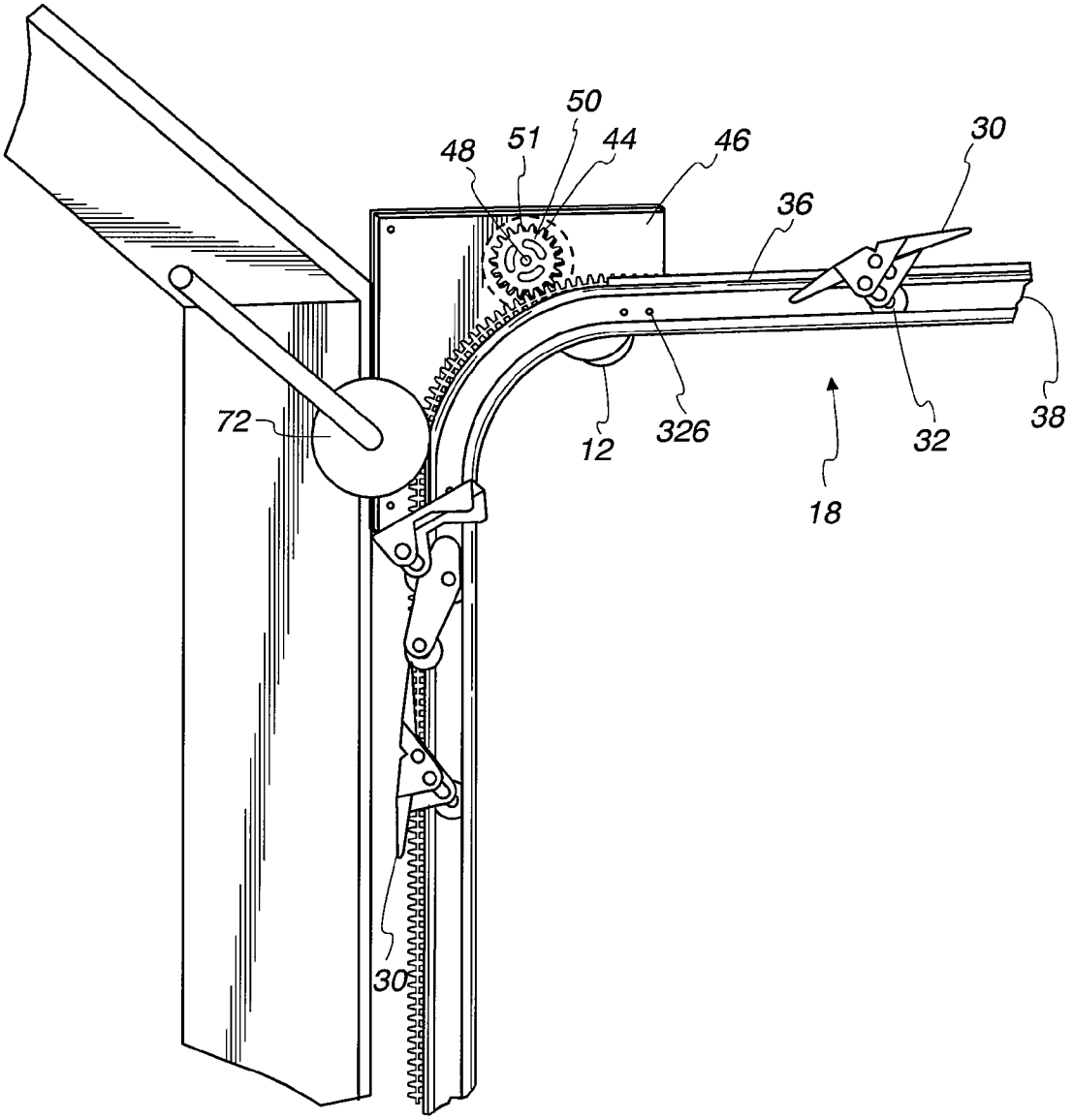
FIG. 1*a* is a perspective view of a mounting assembly holding a pinion and motor on a trolley track.
Figure 3:
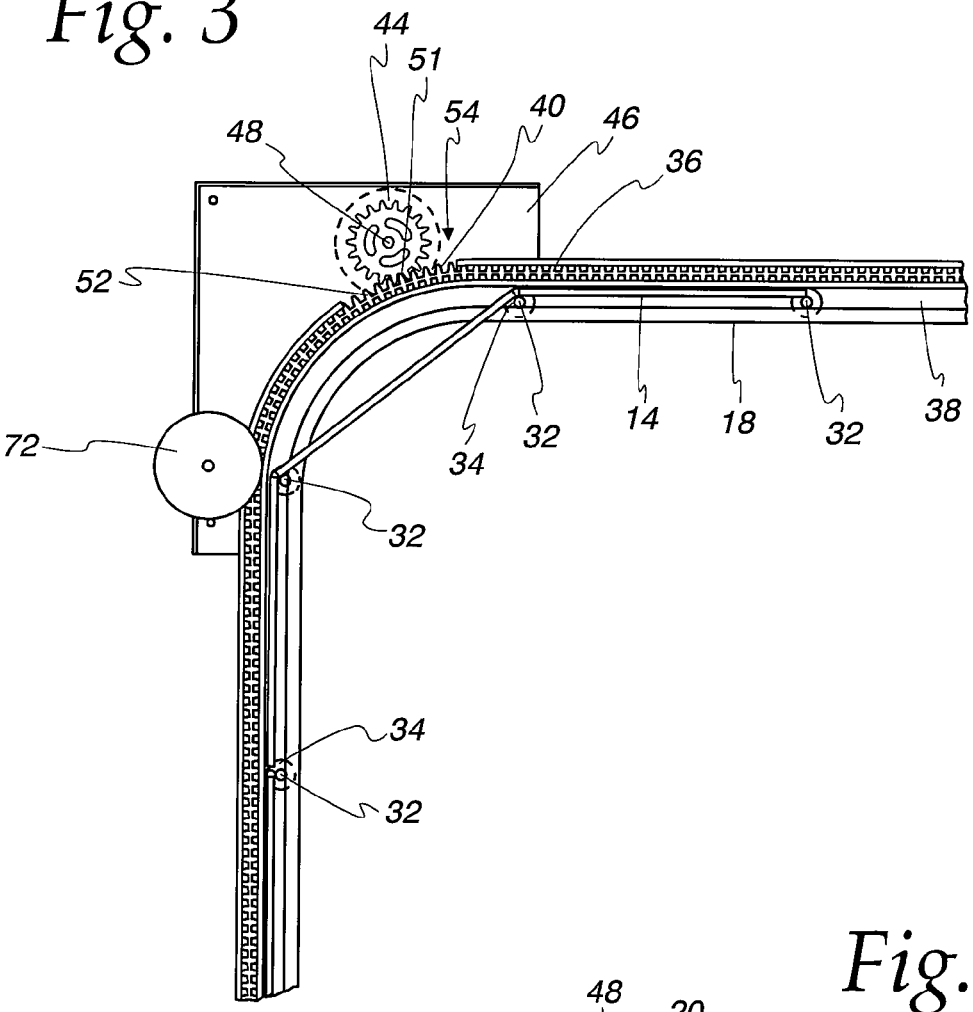
FIG. 3 is a view of an assembled system looking edgewise along the plane of the door and sections of the door and shows how the pinion is mounted on the trolley track with a pinion mounting assembly and with the pinion engaging the rack through a window in a trolley track where the rack is in a channel in the trolley track to the side of the door, the figure also shows rollers which move the door where the rollers are in a second channel in the trolley tracks which second channel is parallel to the first channel for the rack.
Figure 4:
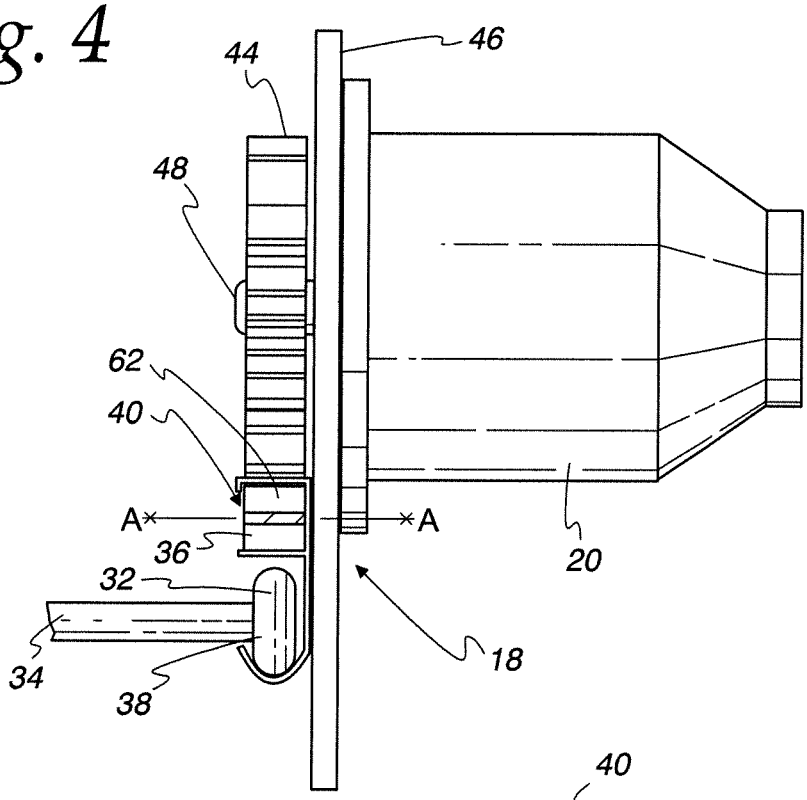
FIG. 4 is a plan view of one embodiment where line A-A seen in FIG. 5 is directed into the page when viewing FIG. 4 where the rack is in a channel in one of the trolley tracks, the rollers are in a second channel in the tracks and the pinion is held in position with a pinion mounting assembly and the pinion is engaging the rack.

As seen in FIGS. 3 and 4, the door sections are carried by a plurality of rollers 32 on shafts 34 on each side of the door. The trolley track 18 includes two channels 36 and 38. A flexible rack 40 is slidably mounted in channel 36 of track 18 to one side of the door and is coupled with coupling assembly 42 (FIG. 1) which includes a rack engagement mechanism 43 and pin engagement mechanism 47. The pin engagement mechanism 47 (FIG. 1) is mounted on the door panel 31 and is configured to engage with a pin (FIGS. 6, 7, 10 and 10 A) to connect the barrier with the motor. The rollers 32 are mounted in channel 38 of trolley track 18 to the side of the opening and carry the door panels up and down the trolley track 18 and the rollers roll longitudinally up and down channel 38 (FIG. 1*a*).

Figure 1B:
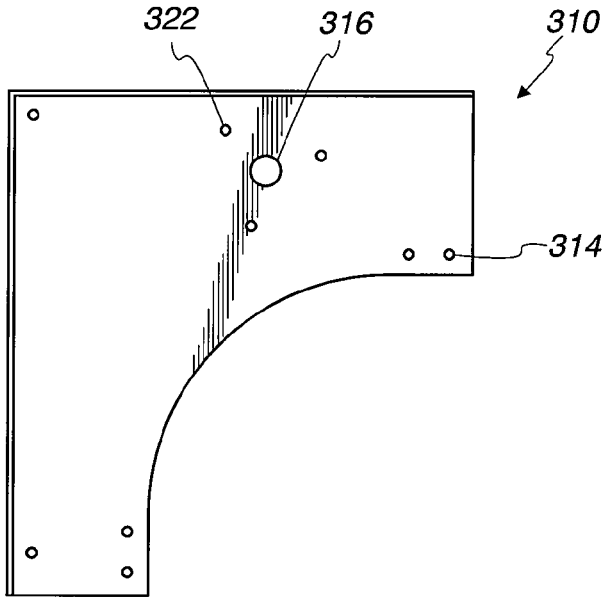
FIG. 1*b* shows a mounting assembly for mounting on a trolley track and configured to hold a motor and a pinion relative to a trolley track and rack.

A pinion 44 is integrally mounted to trolley track 18 with mounting assembly 46. The pinion includes a pinion shaft 48 and pinion sprocket 50 (FIG. 1*a* and FIG. 3). The pinion sprocket has pinion teeth 51. The pinion shaft 48 is rotatably mounted in mounting assembly 46 which positions the pinion and pinion sprocket relative to the trolley track, channel 36 and flexible rack 40. The pinion mounting assembly is mounted to the trolley track with fasteners through holes 314 (FIG. 1*b*) in the assembly, holes 326 (FIG. 1*a*) in the trolley track and holes 324 in motor mounting assembly 320 and positions the pinion relative to the rack as will be described in more detail below.

Figure 2:
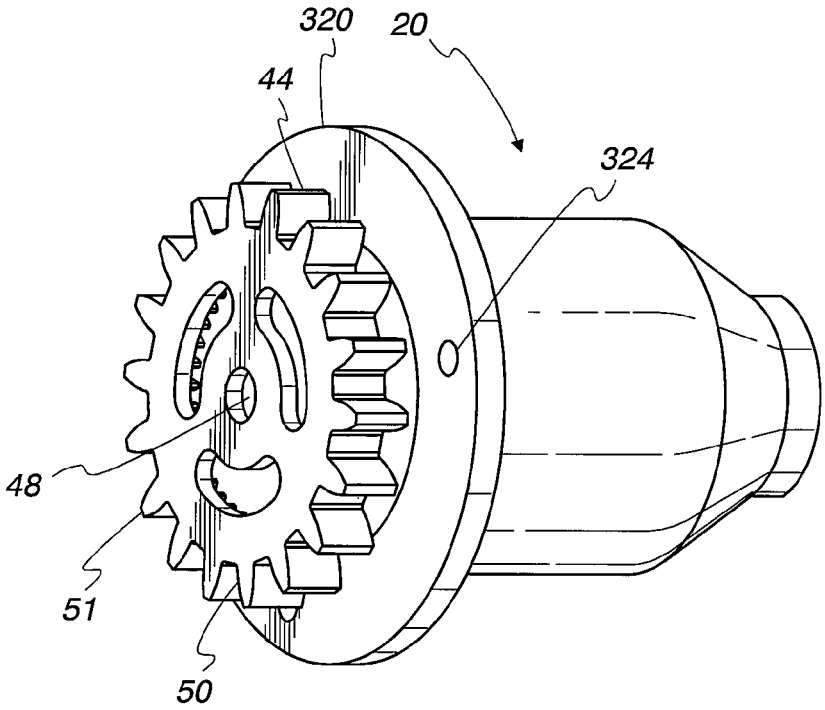
FIG. 2 is a perspective view of a pinion coupled to a motor.

As seen in FIG. 2, the pinion 44 is coupled to the motor 20 through shaft 48. The motor 20 is mounted on a mounting assembly 46 (see FIGS. 1*a*, 1*b* and 3) with the motor mounting assembly 320 which mounting assembly is mounted on one of the tracks. The shaft may be round or geometric in cross section with sides so that the shaft 48 may be rotated by the motor to rotate the pin.

Figure 3A:
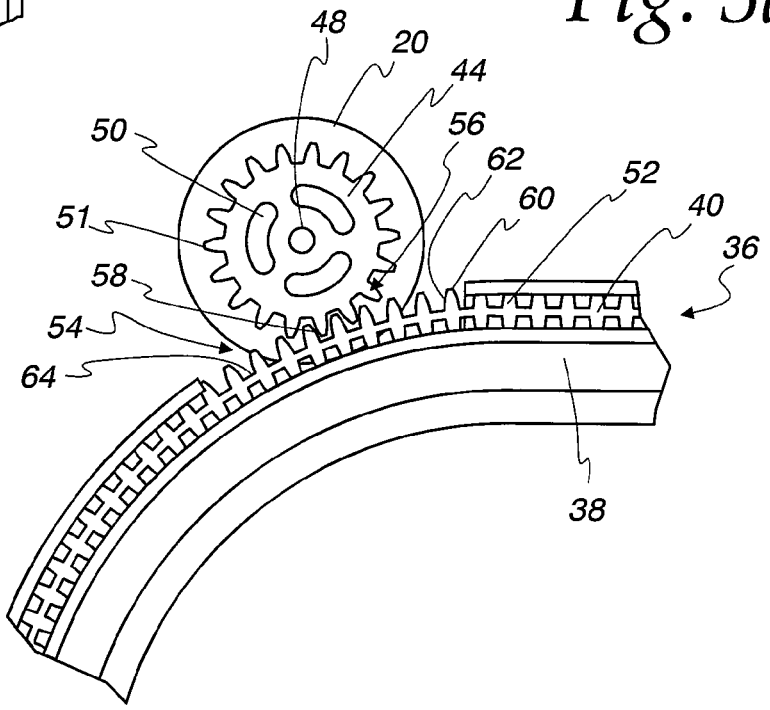
FIG. 3*a* is a blow up of a portion of FIG. 3 without the mounting assembly.

As seen in FIGS. 3, 3*a*, and FIG. 4, the flexible rack 40 has a plurality of rack teeth 52 along the length of the rack. Trolley track 18 has a window or opening 54 which opens channel 36 and exposes the rack and its rack teeth. The pinion teeth 51 can intermesh with the rack teeth through window 54 so that with rotation of the pinion, the pinion teeth drivingly engage the rack teeth as the rack travels through channel 36 in both the upstream direction to open the door and in the downstream direction to close the door as the door rides on rollers 32 in channel 38.

As seen in FIG. 1, the rack is releasably coupled to the door about at the maximum opening desired of the garage when the door is closed, e.g. the upper one third of the door. This makes it easy for a user to decouple the door from the rack and pinion drive if there is a power loss, malfunction of the operator or the user otherwise desires to decouple the door from the operator. In this preferred aspect, the pinion engages the rack about at the maximum opening desired of the garage door, as at panel 31 in FIG. 1, when the door is in the closed position. So positioned, the pinion pushes the rack teeth and the door coupled to the rack to move the rack and door upstream as well as downstream as the coupling point of the rack to the door passes the pinion as the door moves up and down. This positioning permits the rack, the coupling assembly which couples the door to the rack, the pinion, as well as the motor, to be protected from the elements as opposed to having the rack, pinion and motor at the very top or bottom of the door.

Figure 5:
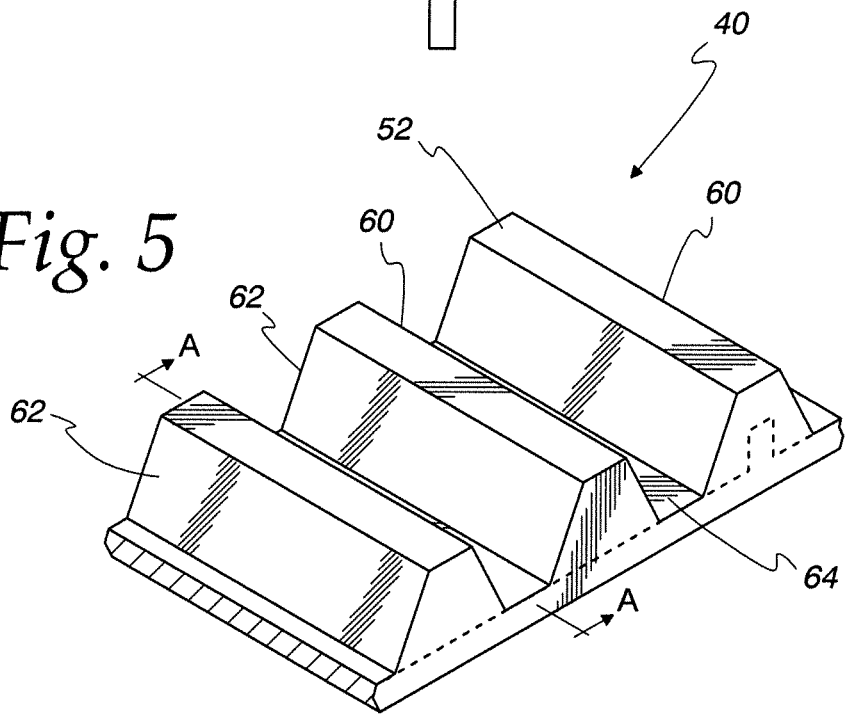
FIG. 5 shows a flexible rack.

As seen in FIGS. 3*a* and 5, the pinion teeth 51 of pinion sprocket 50 has pinion teeth engagement surfaces 56 facing upstream and 58 facing downstream. The rack teeth 52 of rack 40 also have rack teeth engagement surfaces which face upstream 60 and downstream 62. As seen in FIG. 5, the upstream facing surface and downstream facing surface form rack channels with sides 60 and 62 and bottom 64. The pinion teeth engagement surfaces are configured to engage the rack teeth engagement surfaces to exert a force on the rack both upstream the pinion shaft and downstream the pinion shaft which force is effective for moving the barrier both in the upstream direction and downstream direction along the tracks. The upstream facing pinion teeth surface will push onto the downstream facing rack tooth surface 62 to push the rack upstream. Conversely to close a door and move the rack downstream, the downstream facing pinion teeth engagement surfaces will push on the upstream facing rack teeth surfaces 60 to close the door. The mounting assembly 46 holds the rack and pinion relative to each other such that the upstream and downstream teeth surfaces engage each other and the teeth intermesh, but the pinion teeth do not engage the bottom 64 of the channels formed by the rack teeth. As can be seen, the pinion is configured relative to the rack to push the rack such that the rack moves in a direction upstream the pinion and is effective to move the door up along the tracks and is effective to push the rack such that the rack moves in a direction downstream the pinion to move the barrier down along the tracks. In this configuration, the pinion teeth engagement surfaces engage the rack teeth engagement surfaces and exert a force on the rack both upstream the pinion shaft and downstream the pinion shaft which force is effective for moving the carrier both in the upstream direction and downstream direction along the tracks.

Figure 20:
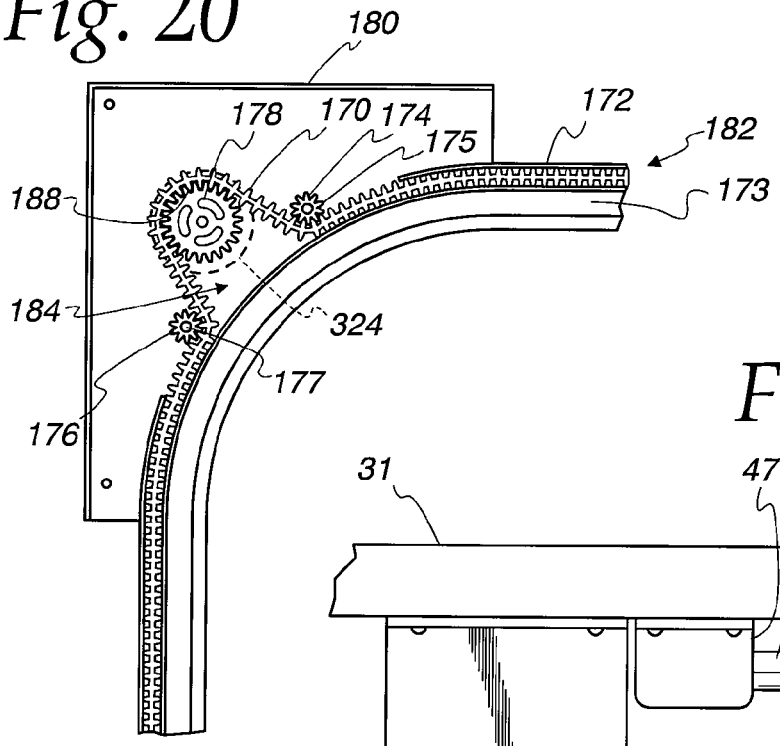
FIG. 20 shows a side view of an alternate embodiment of the rack and pinion drive where two non-driving rollers tension the rack onto the pinion.
Figure 6:
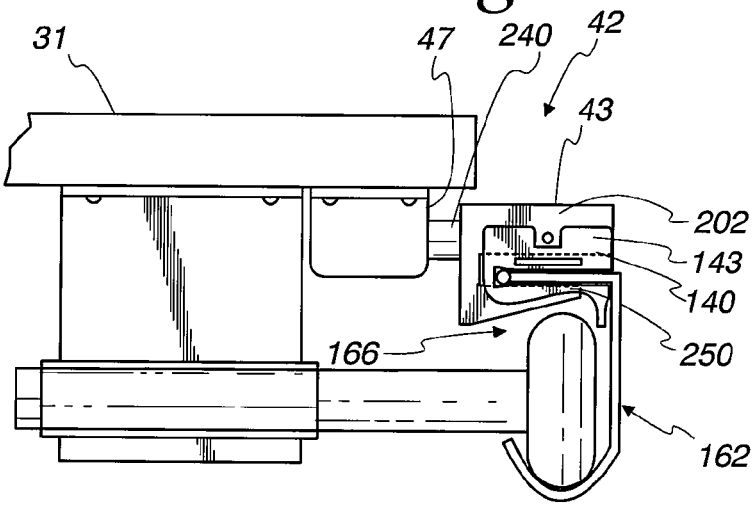
FIG. 6 is a top view of a coupling assembly which links the door with the rack in FIGS. 18 and 19 and the track, in which the rack moves, is cut away.
Figure 8:
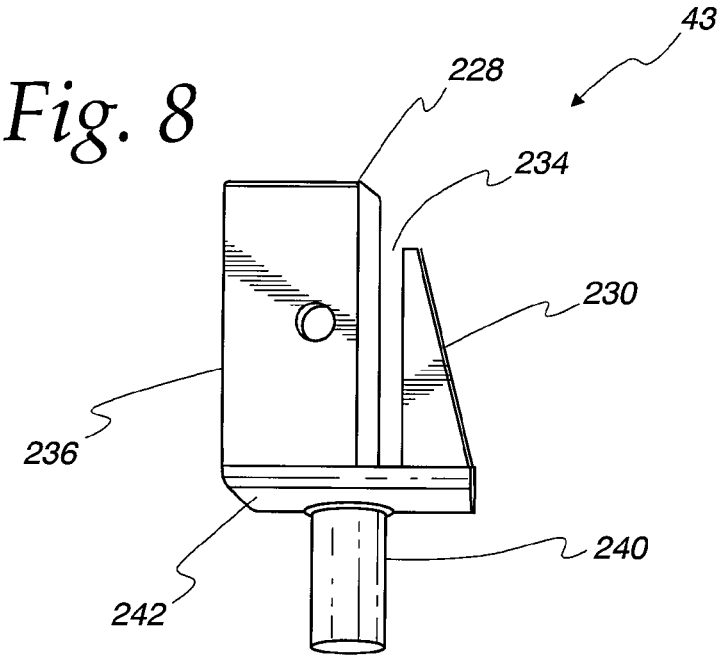
FIG. 8 is a side view of a rack engagement mechanism which at one end has teeth which engage a rack and a pin at the other end which pin engages a second engagement device.
Figure 9:
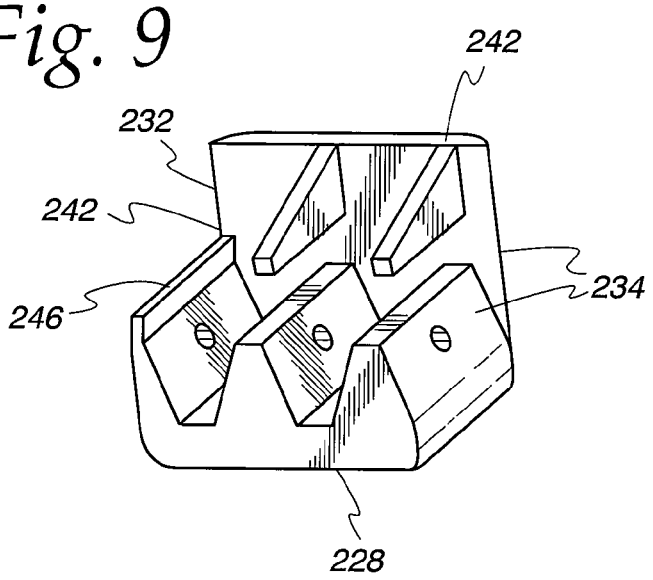
FIG. 9 is a perspective view of the rack engagement mechanism which shows the rack engagement teeth which engage a rack and push the rack along a track.
Figure 10:
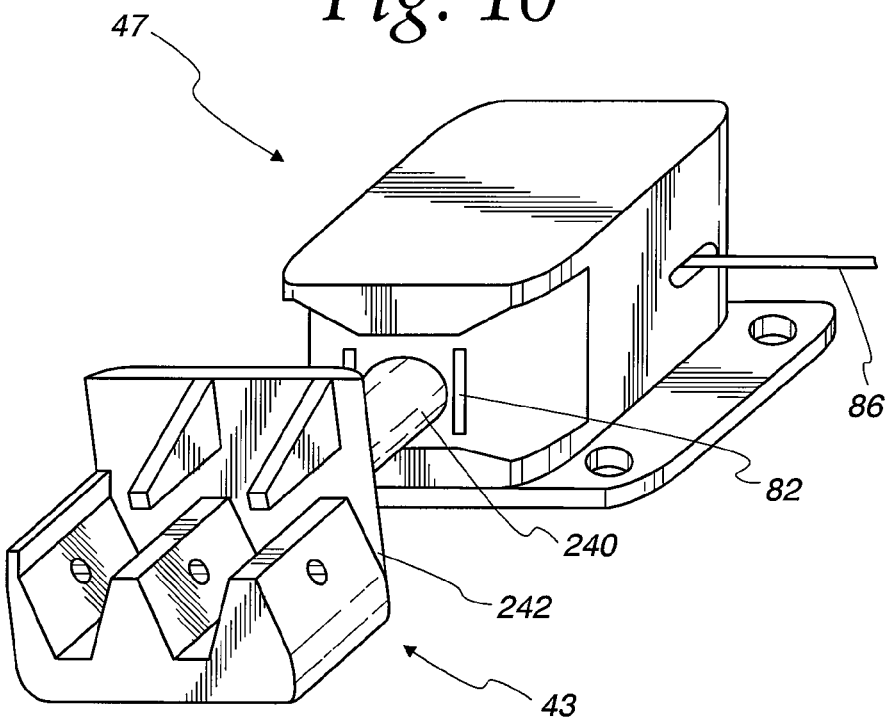
FIG. 10 is an enlarged view of the rack engagement mechanism, a second engagement device having retracted walls which do not engage the pin extending therebetween and which results in a barrier not being coupled to a rack and pinion drive mechanism.
Figure 10A:
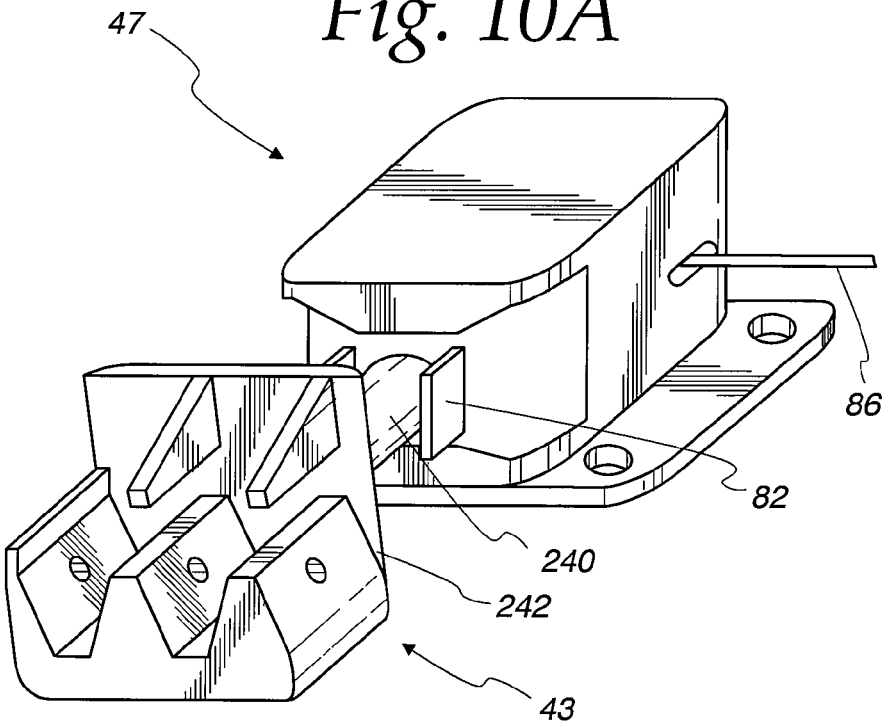
Figure 10B:
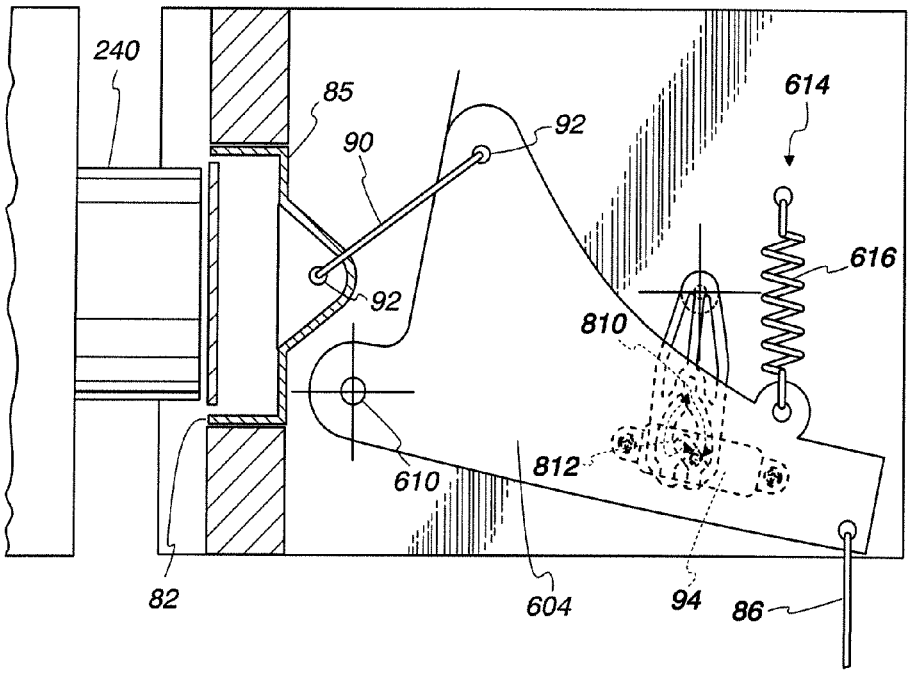
Figure 10C:
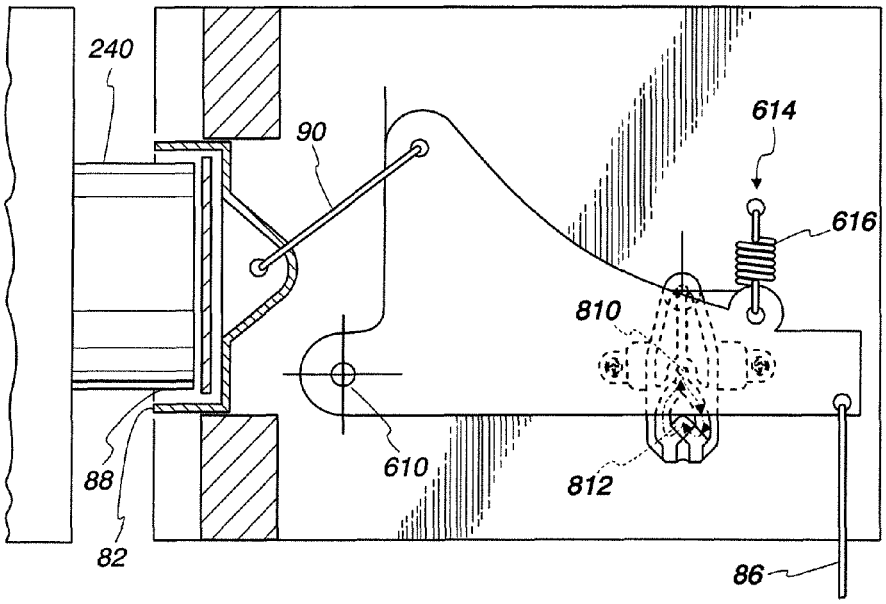

FIGS. 6 through 12 illustrate the coupling assembly 42 which connects the rack with the door to move the door. The coupling assembly includes a rack engagement mechanism 43 and pin engagement mechanism 47 which is attached to a door panel as at 31 (see FIG. 1). FIG. 6, which is shows a top view of the coupling assembly looking down from the top of the door, shows the rack engagement mechanism 43 which includes coupling teeth 202 which intermesh and couple with the rack teeth 143 of rack 140. As seen in FIG. 6, the rack slides along the outside wall of the channel 166 of the trolley track 162 which runs along the side of the opening and door. The rack teeth can also engage the coupling teeth 202 through an elongated slot or open channel in the track where the open channel faces the side edges of the door and exposes rack teeth where the rack travels through a two channeled trolley as seen in FIGS. 3, 3*a* and FIG. 4, or through a window with or without non-driving rollers as seen in FIG. 20. In FIG. 6, however, the rack moves over the surface of the track wall and the rack engagement mechanism slides onto the rack to engage it with coupling teeth 202. In this aspect the track may have an open channel into which the rack engagement mechanism extends to engage the rack. The coupling teeth hold the rack engagement mechanism's position with respect to the length of the rack. The rack engagement mechanism includes an engagement connector pin 240 which engages with pin engagement mechanism 47 which is mounted on the barrier or door. The pin engagement mechanism selectively engages the pin from the rack engagement mechanism so that the pin can drive the door along the tracks as the rack pushes or pulls the pin as the coupling teeth 202 of the rack engagement mechanism 43 engage the rack teeth 143 of rack 140. This selective engagement can be performed by a number of different methods, but for clarity a blocking mechanism is shown where, as seen in FIGS. 10 through 10 C, the position walls 82 of the pin engagement mechanism are controlled to engage the rack engagement mechanism 43. In a preferred aspect, the selective engagement and disengagement at two stable positions occurs where walls 82 of the pin engagement mechanism move from a retracted position to an extended position (see FIGS. 10 and 10 A, respectively) when a lever arm 604 (see FIGS. 10 B and 10 C), which is part of a bistable coupling mechanism, is pivoted around a pivot point when a user pulls rope 86 as described below. Pivoting the lever arm 604, causes the walls to resiliently retract into the interior of the pin engagement mechanism 47 (FIG. 10 B) and out of engagement with pin or shank 240 so that the door and rack can be moved manually. This most often would occur during a power outage. Reengagement is achieved by pulling the rope after disengagement so that the pin engagement mechanism will have its walls extended to reengage with the pin of rack engagement mechanism so that the pinion and motor will control movement of the door through the rack and coupling assembly. The rack engagement mechanism, its pin and the pin engagement mechanism, by coupling the door directly to the rack, and not coupling the door to the rack through the motor, allow reengagement at a specific location keeping the same registration of the motor with respect to the rack and therefore the limits can be carried at the operator and do not need to be separated.

Figure 7:
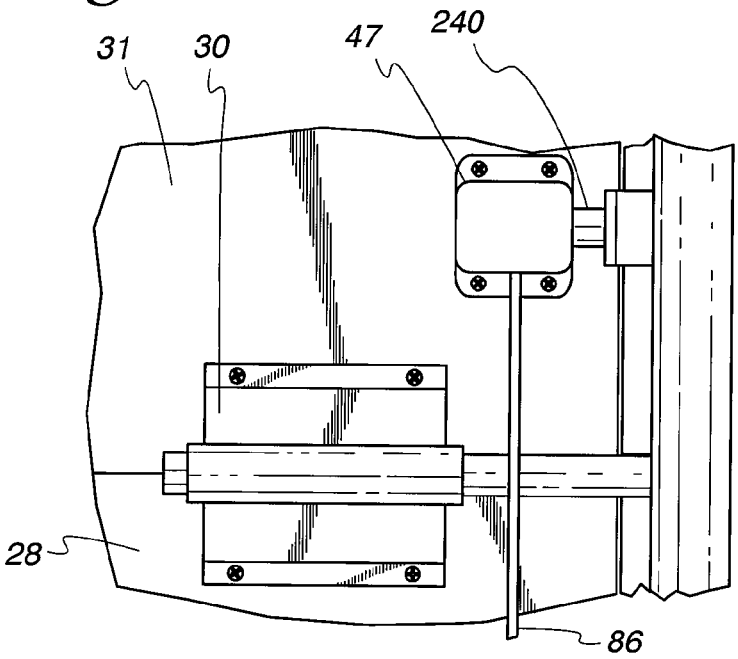
FIG. 7 is a side view of a coupling assembly which links the door with the rack.

FIG. 7 shows the coupling assembly in a front view from the inside of a garage and shows hinge 30 mounted between door panels 28 and 31 with the rack engagement mechanism engaging rack 140 through rack teeth 143 (see FIG. 6).

FIG. 8, FIG. 9, FIG. 10 and FIGS. 10 A through 10 C further illustrate coupling assembly 42, portions of the rack engagement mechanism 43, pin engagement mechanism 47 and coupling mechanism 602. As seen in FIG. 8 the rack engagement mechanism has a lower jaw 230 and upper jaw 236 separated by channel 234. The jaws resiliently fit over and under an open trolley track and extend from a back wall 242. When a rack runs over the surface of the trolley track, jaw teeth 246 (see FIG. 19) of the rack engagement mechanism engage rack teeth. A shank 240 extends from back wall 242 toward the pin engagement mechanism 47.

FIG. 9 shows the rack engagement mechanism in perspective view where the upper jaw 228 has upper jaw teeth 246 which intermesh and engage the rack teeth. The lower jaw has lower jaw teeth or projections which fit under the outer channel wall of the trolley track, as shown at 250 in FIG. 6, to hold the rack engagement assembly in engagement with the rack and on the trolley tracks.

FIG. 10 shows an enlarged perspective view of the coupling assembly 42 with the pin or shank 240 extending from rack engagement mechanism 43 toward pin engagement mechanism 47 where the pin engagement mechanism and the rack engagement mechanism are not coupled or engaged.

FIG. 10 A illustrates the condition where the pin engagement mechanism 47 and the rack engagement mechanism 43 are engaged to connect the barrier with the motor. A difference between the engaged position and disengaged position is the position of walls 82. In the disengaged position, the walls 82, which form a part of a laterally moving extension connector 85, are retracted from pin 240 and allow the pin to pass the pin engagement mechanism. In the engaged position, the walls 82 extend toward pin 240 (see FIGS. 10 A and 10 C) and restrict the movement of the pin 240 with respect to the pin engagement mechanism. The walls can be designed with ramped surfaces allowing the pin to automatically engage the pin engagement mechanism by forcing the walls to retract when the pin is approaching from the outside of the pin engagement mechanism and retaining it within. This is similar (but in opposite operation) to the pin of the house door.

Turning to FIGS. 11 through 17 illustrate the bistable coupling mechanism 602 which forms a part of the coupling assembly which includes the rack engagement mechanism 43 and pin engagement mechanism 47. The pin engagement mechanism 47 includes a bistable coupling mechanism connecting the rack engagement mechanism and pin engagement mechanism with a reciprocating movement of the bistable coupling mechanism between two stable rest positions. The bistable coupling mechanism moves walls 82 between engagement of the pin of the rack engagement mechanism 43 and disengagement of the pin from the walls and the pin engagement mechanism 47.

The bistable coupling mechanism 602 includes reciprocating lever arm 604, cam engaging projection 606 extending orthogonally from the lever arm 604, reciprocating cam plate 608 which abuttingly engages the engaging projection 606. The reciprocating arm 604 is rotatably mounted on a pivot post 610 to permit the reciprocating arm and the cam engaging projection 606 extending orthogonally from the arm to slide on surfaces in channels 612 of the reciprocating cam plate 608 as the lever arm 604 is pivoted around pivot post 610. The reciprocating arm 604 is attached to the door or barrier panel at least two points. These points include the pivot post, which engages a wall of panel 31, and a biasing anchor 614 which holds a biasing mechanism 616, such as a spring.

The pivoting reciprocating cam plate 608 (as seen in FIGS. 11-12 and 16-17) is pivotally mounted on a pivot post 627 below the reciprocating arm 604 and is between the surface of the door panel and the reciprocating arm. Opposite the rear end 621 of the reciprocating arm, the reciprocating arm has a nose end 628 which is coupled to a rigid connector 90 via hooks 92 at each end of the connector. The rigid connector 90 couples the reciprocating arm to a laterally moving extension connector 85 which forms part of the pin engagement mechanism 47. The extension connector includes the arms 82 forming a hole 88. The extension connector 85 moves arms 82 laterally into and out of engagement with pin or shank 240 which forms a part of the rack engagement mechanism 43. Cam plate 608 is shown in more detail in FIGS. 13 through 15.

The cam plate 608 is oblong and has a generally ovoid shape with channels 612 at one end and pivot post 627 as well as one or more troughs 802 at the opposite end. The troughs are optional and provide mechanical strength without adding a lot of material. The cam plate and its surface facing lever arm 604 is stabilized and captivated by clamp 94 extending over the cam plate. Clamp 94 is attached to or coupled to the barrier. The cam plate has a first cam channel 804 includes bottom cam channel surface 806 which provides an upwardly extending ramp surface 808 upon which the cam engaging projection 606 can cam from a first stable rest position 810 to a second stable rest position 812. The ramp surface 808 ends just prior to reaching the second stable rest position with a ledge 814 which drops into the second stable rest position 812. A second ledge 816 drops from the second stable rest position to the base of an upwardly extending second ramp 807 and upwardly extending second ramp surface 818 at the bottom of the second ramp which bottom ramp surface ends in a third ledge 820 which drops into the first stable rest position 810. Access opening 822 adjacent permits the engaging projection 606 to be sidably inserted into the channels of the cam plate for installation and repair.

FIGS. 11, 12, 16 and 17 illustrate how the reciprocating lever arm moves extension connector 85 and walls 82 into and out of a coupling relationship with pin 240 to couple and decouple the barrier from the rack and motor. The reciprocating action of the lever arm and walls 82 of connector 85 is induced by applying a force on the lever arm 604. This force is applied through a connector 86 such as a rope, a wire, a solid rod or any or device which will transfer a pulling force to move the lever arm.

Figure 11:
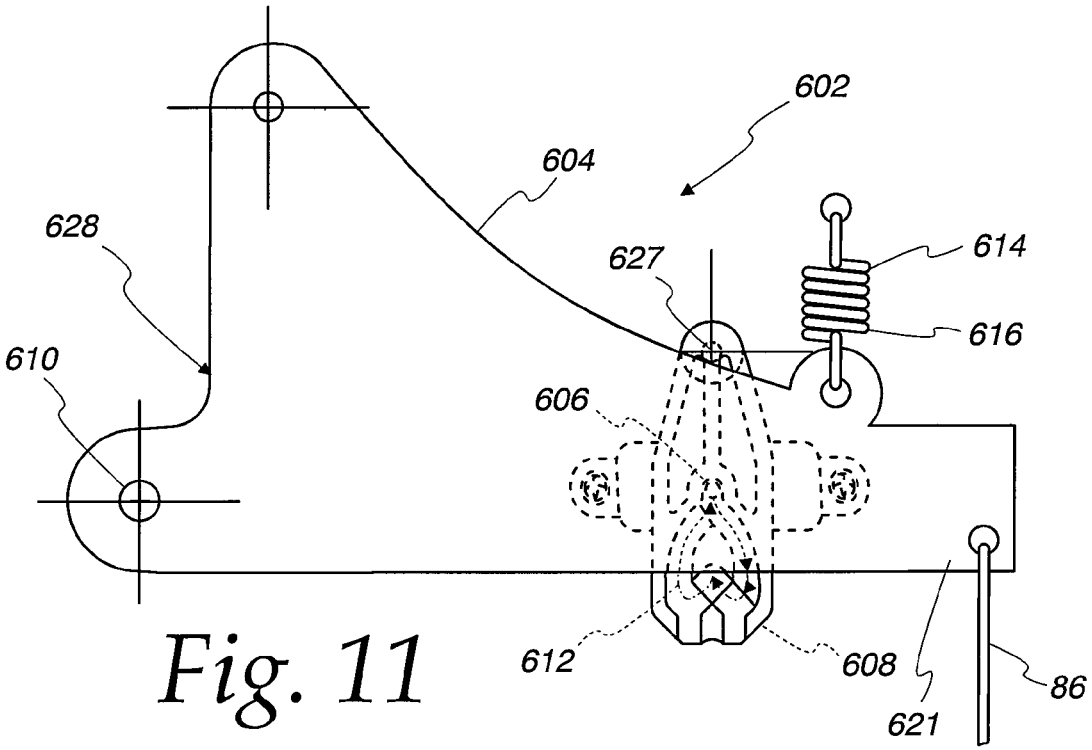
FIG. 11 illustrates the bistable coupling mechanism which includes a reciprocating lever arm and reciprocating cam plate which move a second engagement device into a first stable engaged position with a first engagement device where the barrier is connected to the rack and motor.

FIG. 11 shows the position of the arm which moves walls 82 of pin engagement mechanism 47 to engage the pin 240. In FIG. 11 the nose end 628 of reciprocating arm 604 is at a forward position and therefore the coupling hole 88 formed by walls 82 is moved closer to the lateral position of the pivot point 610. This lateral position extends the walls 82 to engage the pin 240 as shown in FIG. 10 C. In the position shown in FIG. 11, where the pin is engaged with the pin engagement mechanism, the cam engaging projection 606 is in the first rest stable position 810 (see FIGS. 13 and 14).

Figure 12:
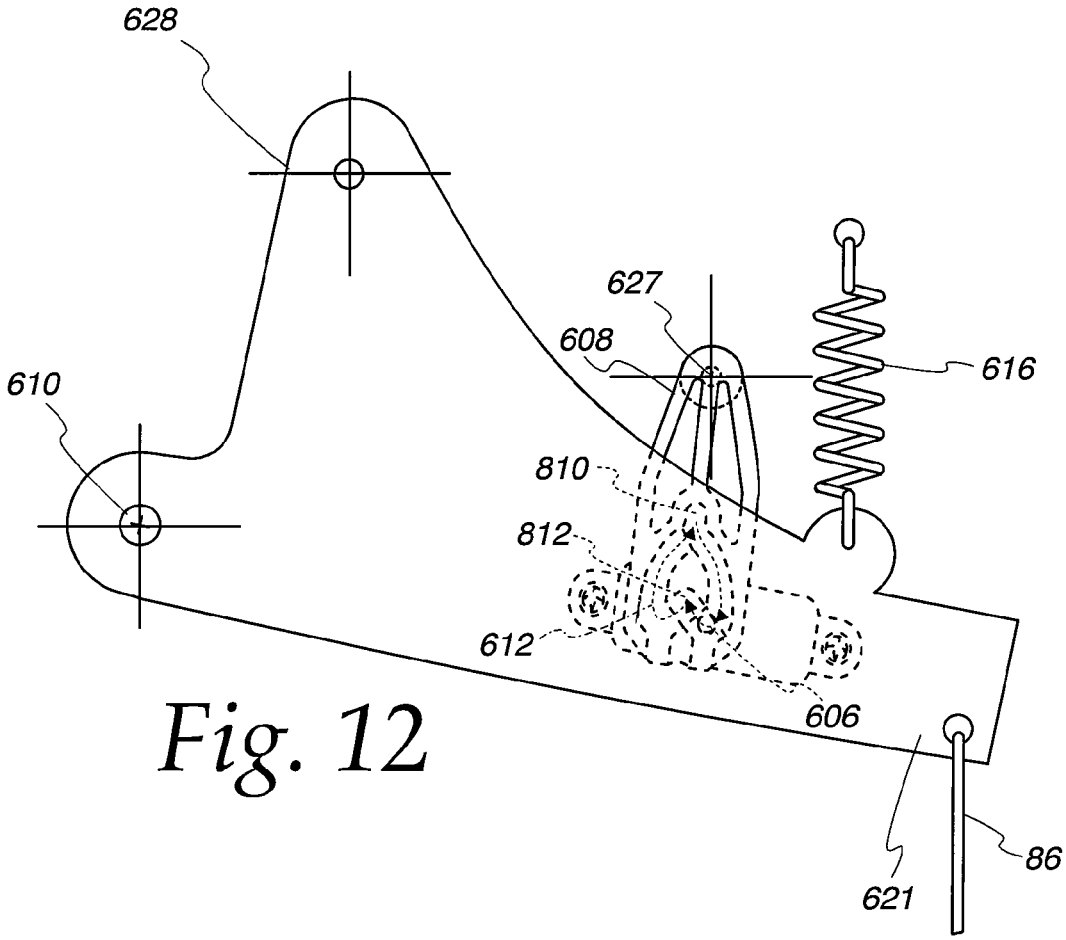
FIG. 12 illustrates the reciprocating lever arm of the bistable coupling mechanism being rotated around a pivot point to disconnect the second engagement device from the first engagement device and to decouple the barrier from the motor in a second stable disengaged position.
Figure 13:
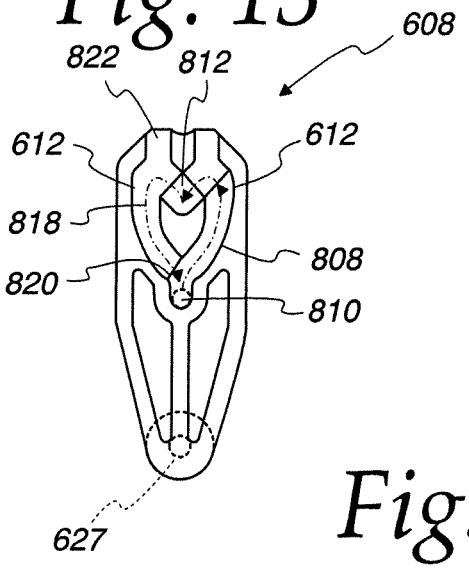
FIG. 13 illustrates a side view of a reciprocating cam plate which has cam channels and surfaces therein which guide the reciprocating lever arm.
Figure 14:
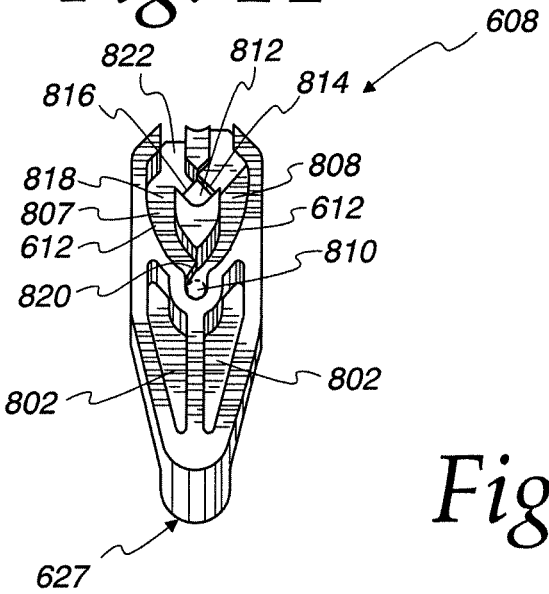
FIG. 14 is a perspective view of the reciprocating cam plate.
Figure 15:
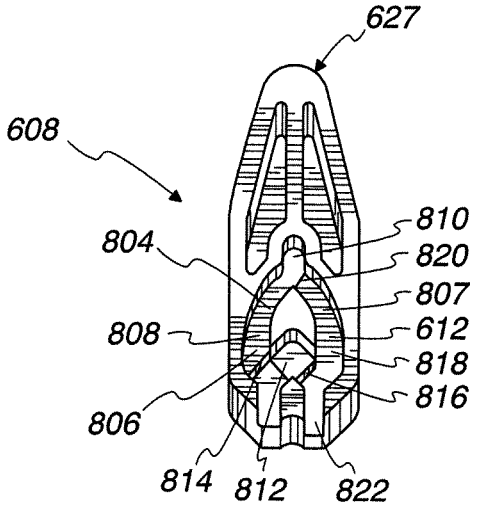
FIG. 15 is a second perspective view of the reciprocating cam plate.

As seen in FIG. 12, to disengage the pin 240 from the pin engagement mechanism, the pulley rope 86 is pulled against the bias created by biasing device 616, and the rear 621 of the reciprocating lever arm 604 is rotated and the nose end 628 of the reciprocating lever arm 604 is moved laterally away from the lateral position of pivot point 610. This lateral position retracts the walls 82 disengaging the pin 240 as shown in 10B. As the rear of the arm is pulled, the cam engaging projection 606 on the reciprocating lever arm slides along upward extending ramp-like surface 808 upon which the cam engaging projection 606 cams from the first stable rest position 810 to the second stable rest position 812. During this caming action of the cam engaging projection, the cam plate 608 pivots around pivot/attachment point 627, and the cam engaging projection drops from the ledge 814 where the ramp surface 808 ends just prior to reaching the second stable rest position and then comes to rest in the second stable rest position 812.

Figure 16:
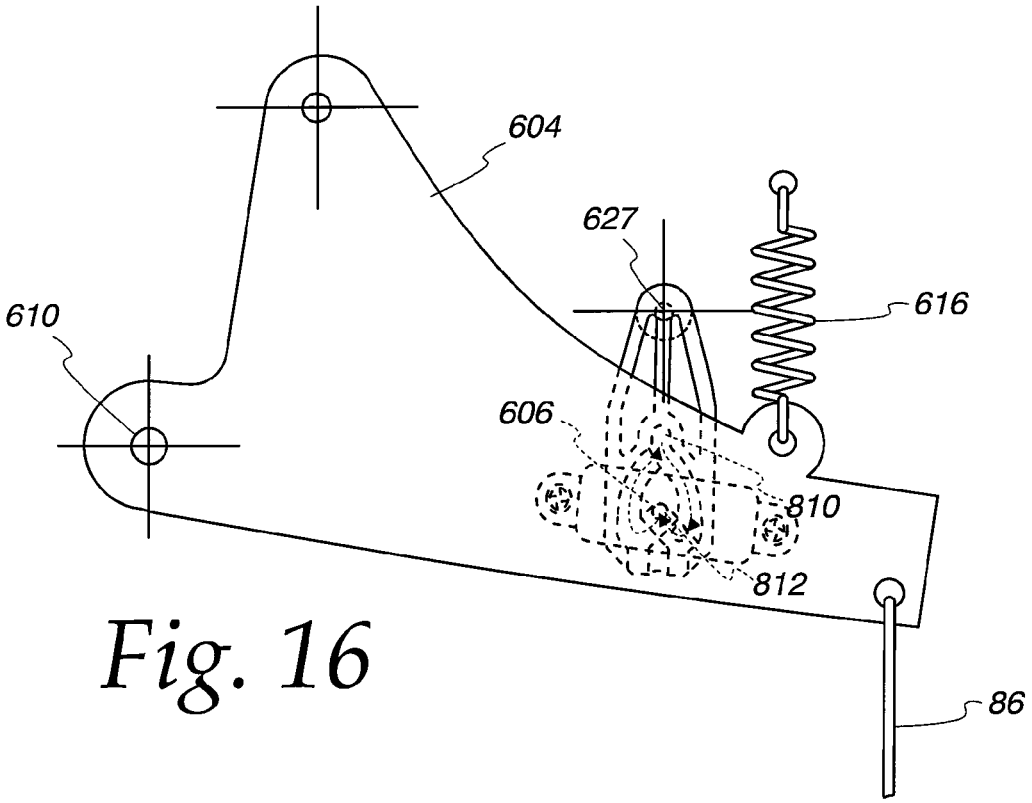
FIG. 16 illustrates a bistable coupling mechanism in a second stable position.

FIG. 16 illustrates the at rest second stable position 812 where the pin 240 is withdrawn from the pin engagement position 47. In this position, the cam engaging projection 606 is in the second stable rest position 812 which lies below the upward level of ramp surface 808 on the reciprocating cam plate 608. In this position, the nose end 628 of the lever arm 604 pulls the walls of the pin engagement mechanism 47 from the pin 240. This position releases the barrier from the pinion, rack and motor.

Figure 17:
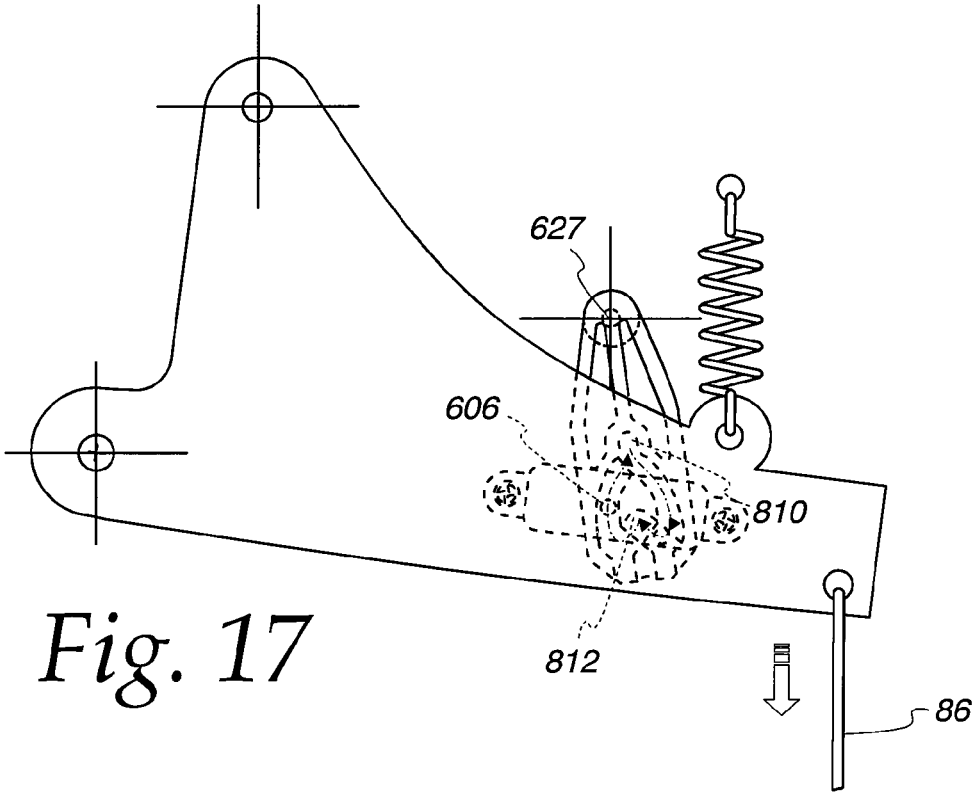
FIG. 17 illustrates a bistable coupling mechanism and moving the reciprocating lever arm from the second stable position.

FIG. 17 illustrates reconnecting the barrier with the pinion rack and motor, and the the extension of the walls 82 of the pin engagement mechanism 47. To move the bistable coupling mechanism into this first stable rest position, the rope 86 is pulled against the bias created by biasing device 616 and the rear 621 of the reciprocating lever arm 604 pulls the extension connector 85 and its walls 82 away from pin 240. The cam engaging projection 606 is pulled from position 812 and drops from ledge 816 onto the base of the upwardly extending ramp surface 818 of the second cam channel 807 as the cam plate rotates around pivot point 627. The bias device 616 pulls the reciprocating arm and cam engaging projection 606 along the upward ramp surface 818 of the cam plate 608 to the third ledge 820 (see FIGS. 14 and 15) which is above the first stable rest position 810. The cam engaging projection 606 drops from this ledge into the first stable rest position 810 and the pin 240 is engaged with the pin engagement position 47.

FIGS. 18 and 19 illustrate other embodiments of the barrier operating system where a rack is shown which permits it to be used with a trolley track 162 (see FIG. 19) with one channel track. This type of trolley track is now commonly in use. As seen in FIG. 18, the rack has teeth 143 and a base section 144. The base section has a plurality of resilient fingers 146, the teeth and fingers being separated by a longitudinal rack channel 148 which forms a slide for movement of the rack relative to the trolley track. As seen in FIG. 19, the pinion 160 and motor 306 are mounted on pinion mounting assembly 46 through which pinion shaft extends into the motor. The resilient fingers of the rack extend orthogonal to the trolley track 162 and slide along the interior surface of the track wall 164. The base section slides into the track channel 166 in the trolley track which is also configured to have rollers 168 to move the door. The rack channel 148 moves and slides over and under the track wall as the rack moves as it is pushed or pulled along the trolley tracks.

The body of the rack 150 seen in FIG. 18 may be molded, but also may be reinforced with a reinforcing member 152 extending longitudinally down the length of the rack and around which a molding material for the rack is molded. In this embodiment the pinion 160 is coupled to motor 306. As seen in FIG. 19, the pinion 160 is coupled to the track so that the pinion teeth 159 intermesh with the rack teeth with the rack riding on the surface of the trolley track. The rack also may have an indexing channel 154 (FIG. 18) which will engage an indexing wheel 158 on the pinion 160. The pinion and motor are affixed to the track 162 by coupling motor mounting assembly 320 to the pinion mounting assembly 46, the pinion mounting assembly being mounting to trolley tract 162.

FIG. 20 illustrates another embodiment, especially where the rack is within a track as shown in FIGS. 3 and 3*a*. In this embodiment, a rack 170 rides within a channel 182 in a trolley track 172 and emerges from the track channel 182 into a window 184 and then under two non-driving rollers 174 and 176. The non-driving rollers are mounted on shafts 177 which extend through holes in mounting assembly 180, which mounting assembly is mounted on the track. The non-driving rollers have teeth 175 which engage the rack and are positioned on each side (upstream and downstream) of the pinion 178. The rack has rack teeth which engage pinion teeth 188. The rack teeth are on the underside of the rack. The rack is mounted over the pinion with the non-driving rollers configured to effect engagement of the flexible rack with the pinion as the pinion moves the rack along the track after assembly of the system. The non-driving rollers place tension on the rack to create forces which push the rack teeth down into the teeth 188 of pinion 178. The mounting assembly 180 is mounted onto track 172 with fasteners, such as rivets or screws, and holes in the mounting assembly position and track 172, the pinion, its shaft, as well as the non driving rollers via their shafts, relative to the rack after the mounting assembly is mounted onto the track with the prepositioned holes in the track and mounting assembly. The motor driving the pinion also is mounted on the mounting assembly 180 with rivets or screws through a motor mounting assembly 320 and its holes 324 (See FIG. 2).

Figure 21:
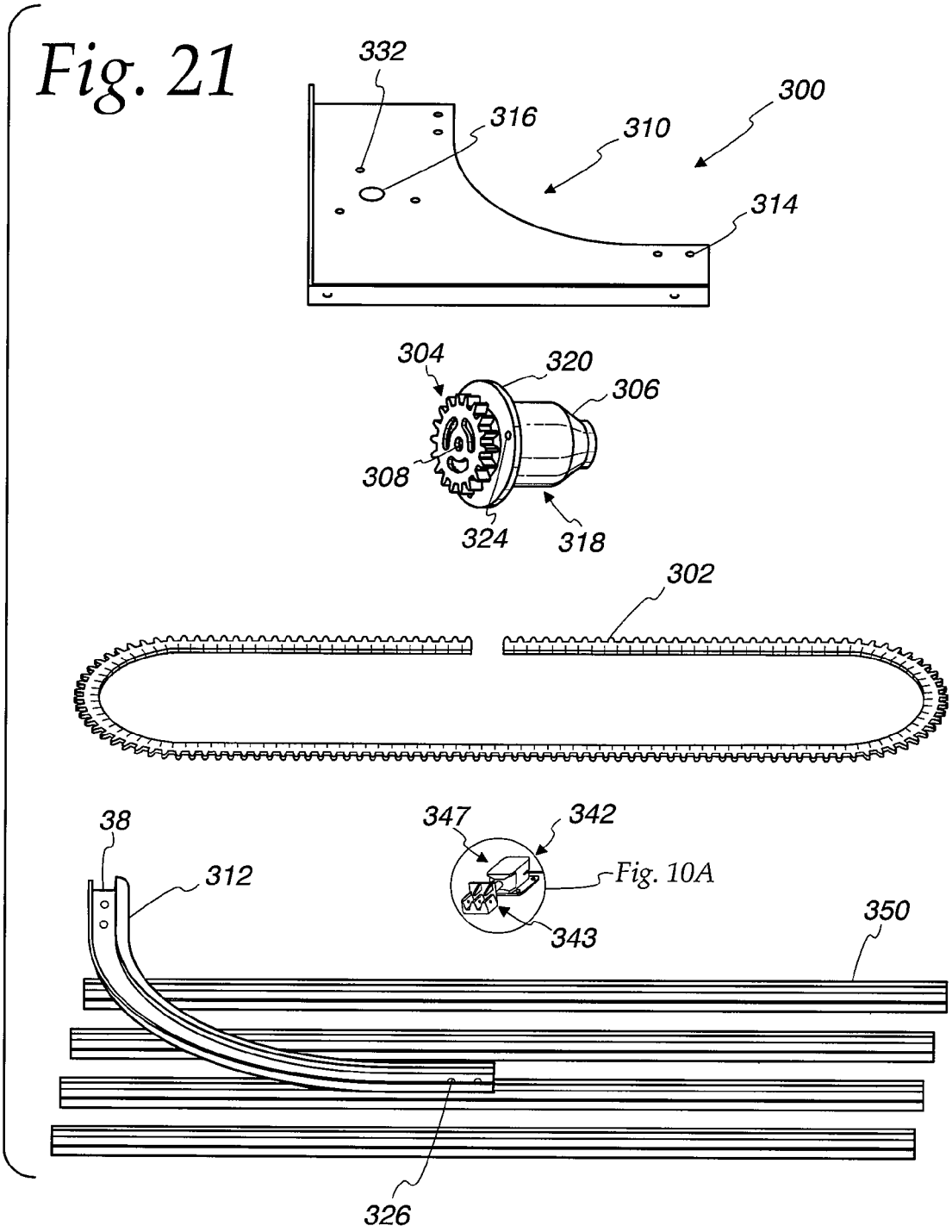
FIG. 21 shows the parts of a kit which pre-positions the pinion for engagement with the rack for assembly into a system where the pinion engages rack teeth without touching the base of the teeth or bottom of the pinion.

FIG. 21 illustrates an unassembled the kit which when assembled provides the barrier operator system. The kit 300 includes at least one flexible rack 302 (illustrated schematically in this figure and which may be configured as shown in FIG. 18), pinion 304, and a pinion mounting assembly 310 which is configured to be mounted on the at least one track section 312 to make the assembly and pinion an integral part of the track section and to position the pinion relative to the rack. The pinion is mounted on a shaft 308 which is driven by motor 306. The track section when coupled with the mounting assembly positions the pinion relative to the rack and makes the pinion an integral part of the track on which the door moves when the kit is assembled with the door, its tracks and motor. The kit also can optionally include a coupling assembly as described herein, a head 318 which includes an electric motor 306, a controller for controlling the operation of the barrier operator and a motor mounting assembly 320 with holes 324 for fixing the motor 306 to the mounting assembly 310. The mounting assembly 310 has holes 314 for receiving fasteners to affix the mounting assembly to a track section 312 which also has holes 326 which are configured to match the holes 314 so that the mounting assembly may be positioned on and fastened to the track section 312. The mounting assembly also has hole 316 through which the pinion shaft 308 will pass to operatively engage with motor 306. Holes 322 in the mounting assembly 310 are positioned so that fasteners such as bolts, screws or rivets may fix the motor 306 to the mounting assembly by virtue of the fasteners engaging motor mounting assembly 320 and holes 324 in that assembly. The kit also optionally can include coupling assembly 342 which includes a rack engagement mechanism 343 and pin engagement mechanism 347. The rack engagement mechanism 343 and pin engagement mechanism 347 of the coupling assembly 342 are configured to be mounted to a door panel as described in connection with coupling assembly 42, rack engagement mechanism 43 and pin engagement mechanism 47. As noted above, the rack engagement mechanism, its pin and pin engagement mechanism, by coupling the door directly to the rack, and not coupling the door to the rack through the motor, allow reengagement at a specific location keeping the same registration of the motor with respect to the rack and therefore the limits can be carried at the operator and do not need to be separated. FIGS. 10 through 10 C show an enlarged perspective view of the coupling assembly 342 and pin mechanism 347.

In addition to the track section 312 which is to be coupled to the mounting assembly 310, the kit also may include a plurality of additional track section assemblies 350 which are configured be assembled into two sets of tracks which are to be mounted to the walls and ceiling of a room such as a garage. The tracks when assembled are parallel and form trolley tracks for rollers mounted on a barrier, such as an overhead garage door. Mounting the door and its rollers on the trolley tracks permits movement of the door along the tracks to open and close the door. The additional track sections optionally provide a kit with at least four straight sections coupled by at least two curved sections. When assembled, two of the straight sections 224, 225 (see FIG. 1) will be vertical to ground and two straight sections 226, 227 (FIG. 1) will be horizontal to ground.

The invention claimed is:

1. A barrier operator apparatus comprising:

at least two side tracks, at least first one of the a two side tracks disposed on a first side of a barrier for a barrier opening and a second one of the at least two side tracks disposed on a second side of the barrier for the barrier opening, the second side of the barrier opposite the first side of the barrier, the at least two side tracks configured to support and guide up and down movement of the barrier between an open position and a closed position;

a motor which is configured to move the barrier along the at least two side tracks;

a push-pull drive mechanism riding along at least one of the at least two side tracks, the push-pull drive mechanism configured to drive the barrier along the at least one of the at least two side tracks between the open and the closed positions by pushing on the barrier and pulling on the barrier to move the barrier when the drive mechanism is coupled to the barrier; and a coupling assembly which includes a drive mechanism engagement device, a pin engagement device and a bistable engagement device, the drive mechanism engagement device is disposed between the barrier and the drive mechanism, the drive mechanism engagement device configured to engage the drive mechanism;

the pin engagement device configured to be mounted on the barrier and situated adjacent to the at least one of the at least two side tracks, the pin engagement device disposed between the barrier and the drive mechanism; and the bistable engagement device is housed with the pin engagement device, the bistable engagement device having at least two stable states, wherein when the bi-stable engagement device is in one of the stable states the drive mechanism engagement device engages with the pin engagement device and wherein when the bi-stable engagement device is in the second stable state the drive mechanism engagement device is not engaged with the pin engagement device.

2. The barrier operator apparatus of claim 1 wherein the bistable engagement device includes a cam plate, a resiliently reciprocating lever arm and a cam engaging projection extending from the lever arm, the cam plate having cam surfaces along which the cam engaging projection moves as the lever arm is resiliently reciprocated, the cam surfaces providing at least two stable rest cam positions in which the cam engaging projection can rest, the resiliently reciprocating lever arm configured to move the pin engagement device and the drive mechanism engagement device between a first stable engaged position and a second stable disengaged position as the cam engaging projection moves along the cam surfaces between a first one of the stable cam positions and a second one of the stable cam positions, respectively the first and second stable cam positions corresponding to the first stable state and the second stable state.

3. The barrier operator apparatus of claim 2 wherein the pin engagement device includes movable walls, and wherein the movable walls are configured to move into and out of engagement with the drive mechanism engagement device.

4. The barrier operator apparatus of claim 2 wherein the lever arm and the cam engaging projection are generally orthogonal to each other, the cam plate and the reciprocating lever arm are in planes generally parallel to each other, the coupling assembly further including an engagement connector pin connected to the drive mechanism engagement device, and the pin engagement device having an aperture configured to engage the pin.

5. The barrier operator apparatus of claim 2 wherein the lever arm and the cam engaging projection are generally orthogonal to each other, and the cam plate and the reciprocating lever arm are in planes generally parallel to each other.

6. A barrier operator apparatus comprising:

side tracks arranged at sides of a barrier, the side tracks configured to guide up and down movement of the barrier between an open position and a closed position;

a motor which is configured to move the barrier along the side tracks;

a push-pull drive mechanism riding along at least one of the side tracks, the push-pull drive mechanism configured to drive the barrier along the at least one of the side tracks between the open and the closed position by pushing on the barrier and pulling on the barrier to move the barrier when the drive mechanism is coupled to the barrier; and a coupling assembly which includes a drive mechanism engagement device, a bistable engagement device and a pin engagement device which includes movable walls, the drive mechanism engagement device is disposed between the barrier and the drive mechanism, the drive engagement device is configured to couple to the drive mechanism;

the pin engagement device is configured to be mounted on the barrier and be disposed between the barrier and the drive mechanism; and the bistable engagement device is housed with the pin engagement device, the bistable engagement device having at least a first stable state and a second stable state, wherein in the first stable state the drive mechanism engagement device engages with the pin engagement device and wherein in the second stable state the drive mechanism engagement device is not engaged with the pin engagement device, the pin engagement device engages and disengages the drive mechanism engagement device by controlling a position of the movable walls which move into and out of engagement with the drive mechanism engagement device.

7. The barrier operator apparatus of claim 6 wherein the bistable engagement device includes a cam plate, a resiliently reciprocating lever arm and a cam engaging projection extending from the lever arm, the cam plate having cam surfaces along which the cam engaging projection moves as the lever arm is resiliently reciprocated, the cam surfaces providing at least a first stable rest cam position and a second stable rest cam position for the cam engaging projection, the resiliently reciprocating lever arm configured to move the pin engagement device and the drive mechanism engagement device between a first stable engaged position and a second stable disengaged position as the cam engaging projection moves along the cam surfaces between the first and second stable cam positions, the first and second stable cam positions corresponding to the first stable state and the second stable state.

* * * * *

UNITED STATES PATENT AND TRADEMARK OFFICE

CERTIFICATE OF CORRECTION

PATENT NO. : 8,935,883 B2
APPLICATION NO. : 12/496512
DATED : January 20, 2015
INVENTOR(S) : Bruce Arthur Coubray and Alan Keith Coubray It is certified that error appears in the above-identified patent and that said Letters Patent is hereby corrected as shown below:

TITLE PAGE:

Item (57); Line 10; Change “over head” to -- overhead --;

IN THE CLAIMS:

Claim 1, Column 17, Line 40; Change “at least first one of the a two” to -- a first one of the at least two --;

Claim 2, Column 17, Line 23; Change “respectively” to -- respectively, --;

Claim 6, Column 17, Line 51; Change “position” to -- positions --; and

Claim 6, Column 17, Line 59; Insert -- mechanism -- before “engagement”.

Signed and Sealed this
Fourth Day of August, 2015

Michelle K. Lee

Michelle K. Lee
*Director of the United States Patent and Trademark Office*